US009520144B2

(12) United States Patent
Gunawan et al.

(10) Patent No.: US 9,520,144 B2
(45) Date of Patent: Dec. 13, 2016

(54) DETERMINING A HARMONICITY MEASURE FOR VOICE PROCESSING

(71) Applicant: Dolby Laboratories Licensing Corporation, San Francisco, CA (US)

(72) Inventors: David Gunawan, Sydney (AU); Glenn N. Dickins, Como (AU)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 24 days.

(21) Appl. No.: 14/384,842

(22) PCT Filed: Mar. 21, 2013

(86) PCT No.: PCT/US2013/033363

§ 371 (c)(1),
(2) Date: Sep. 12, 2014

(87) PCT Pub. No.: WO2013/142726

PCT Pub. Date: Sep. 26, 2013

(65) Prior Publication Data

US 2015/0032447 A1 Jan. 29, 2015

Related U.S. Application Data

(60) Provisional application No. 61/614,525, filed on Mar. 23, 2012.

(51) Int. Cl.

| | |
|---|---|
| ***G10L 19/093*** | (2013.01) |
| ***G10L 25/84*** | (2013.01) |
| *G10L 25/93* | (2013.01) |

(52) U.S. Cl.

CPC ..... *G10L 25/84* (2013.01); *G10L 2025/937* (2013.01)

(58) Field of Classification Search

CPC ..... G10L 19/00; G10L 19/02; G10L 19/08; G10L 19/09; G10L 19/093; G10L 19/125; G10L 25/00; G10L 25/18; G10L 25/45; G10L 25/78; G10L 25/81; G10L 25/84; G10L 25/90; G10L 25/93

(Continued)

(56) References Cited

U.S. PATENT DOCUMENTS

| | | | |
|---|---|---|---|
| 5,195,166 | A | 3/1993 | Hardwick |
| 5,272,698 | A | 12/1993 | Champion |

(Continued)

FOREIGN PATENT DOCUMENTS

| | | |
|---|---|---|
| EP | 1744303 | 1/2007 |
| WO | 2011/103488 | 8/2011 |

OTHER PUBLICATIONS

Freund, Y. et al "A Decision-Theoretic Generalization of On-line Learning and an Application to Boosting" Sep. 20, 1995, pp. 1-34.

(Continued)

*Primary Examiner* — Qi Han

(57) ABSTRACT

A method, an apparatus, and a computer-readable medium configured with instructions that when executed carry out the method for determining a measure of harmonicity. In one embodiment the method includes selecting candidate fundamental frequencies within a range, and for candidate determining a mask or retrieving a pre-calculated mask that has positive value for each frequency that contributed to harmonicity, and negative value for each frequency that contributes to inharmonicity. A candidate harmonicity measure is calculated for each candidate fundamental by summing the product of the mask and the magnitude measure spectrum. The harmonicity measure is selected as the maximum of the candidate harmonicity measures.

20 Claims, 9 Drawing Sheets

(58) Field of Classification Search
USPC ..... 704/233, 205, 206, 207, 208
See application file for complete search history.

(56) References Cited

U.S. PATENT DOCUMENTS

| | | | | |
|---|---|---|---|---|
| 6,201,176 | B1 * | 3/2001 | Yourlo | G06F 17/30743 434/307 A |
| 7,337,107 | B2 | 2/2008 | Rose | |
| 7,594,423 | B2 * | 9/2009 | Padhi | G01L 23/225 73/114.07 |
| 7,970,606 | B2 * | 6/2011 | Hardwick | G10L 19/087 704/208 |
| 2005/0201204 | A1 | 9/2005 | Dedieu | |
| 2007/0027681 | A1 | 2/2007 | Kim | |
| 2007/0288232 | A1 | 12/2007 | Kim | |
| 2009/0119097 | A1 * | 5/2009 | Master | G10H 1/0008 704/207 |
| 2009/0226010 | A1 | 9/2009 | Schnell | |
| 2010/0063803 | A1 * | 3/2010 | Gao | G10L 21/0364 704/205 |
| 2010/0142732 | A1 | 6/2010 | Craven | |

OTHER PUBLICATIONS

Hardcastle, W.J. et al "The Handbook of Phonetic Sciences" Wiley, 1999.

Scholkopf, B. et al "Learning with Kernels: Support Vector Machines, Regularization, Optimization, and Beyond", Cambridge, MA, MIT Press, 2001.

Xuejing Sun, "Pitch Determination and Voice Quality Analysis Using Subharmonic-to-Harmonic Ratio," Acoustic, Speech, and Signal Processing (ICASSP) 2002 IEEE International Conference, pp. I-333-I-336, May 13-17, 2002.

X. Sun et al., "Robust Noise Estimation Using Minimum Correction with Harmonicity Control," Interspeech, Makuhari, Japan, 2010.

Arturo Camacho, "Swipe: A Sawtooth Waveform Inspired Pitch Estimator for Speech and Music," Dec. 31, 2007, pp. 1-46, http://www.kerwa.ucr.ac.cr/bitstream/handle/10669/536/disseration.pdf?sequence=1, May 21, 2013.

Xuejing Sun, "A Pitch Determination Algorithm Based on Subharmonic-to-Harmonic Ratio," Department of Communication Sciences and Disorders, Northwestern University, pp. 1-4, Oct. 16, 2000.

M. R. Schroeder, "Period Histogram and Product Spectrum: New Methods for Fundamental-Frequency Measurement," Acoustical Society of America Journal, 1968, vol. 43, Issue 4, pp. 829-834, Jan. 5, 1968.

D. J. Hermes, "Measurement of Pitch by Subharmonic Summation," J. Acoustic. Society, Am., vol. 83, pp. 257-264, 1988.

L. Daudet and M. Sandler, "MDCT Analysis of Sinusoids: Exact Results and Applications to Coding Artifacts Reduction," IEEE Transactions on Speech and Audio Processing, vol. ASSP-12, No. 3, pp. 302-312, May 2004.

H. Kameoka, "A Multipitch Analyzer Based on Harmonic Temporal Structured Clustering," IEEE Transactions on Audio, Speech, and Language Processing, vol. 15, No. 3, Mar. 2007.

Anssi Klapuri, "Multiple Fundamental Frequency Estimation by Summing Harmonic Amplitudes," Institute of Signal Processing, Tampere University of technology, 2006.

Dongmei Wang and Qinghua Huang, "Single Channel Music Source Separation Based on Harmonic Structure Estimation," Circuits and Systems, 2009, ISCAS IEEE International Symposium, pp. 848-851, May 24-27, 2009.

H. Fujihara et al., "F0 Estimation Method for Singing Voice in Polyphonic Audio Signal Based on Statistical Vocal Model and Viterbi Search," Acoustics, Speech and Signal Processing, 2006, ICASSP, May 14-19, 2006.

E. Vincent et al., "Adaptive Harmonic Spectral Decomposition for Multiple Pitch Estimation," IEEE Transactions on Audio, Speech, and Language Processing, pp. 528-537, Oct. 9, 2009.

S. Srinivasan and D. Wang, "Robust Speech Recognition by Integrating Speech Separation and Hypothesis Testing," Journal of Speech Communication Archive, vol. 52, Issue 1, pp. 89-92, Mar. 18-23, 2005.

T Nakatani et al., "A Method for Fundamental Frequency Estimation and Voicing Decision: Application to Infant Utterances Recorded in Real Acoustical Environments," Journal of Speech Communications Archive, vol. 50, Issue 30, pp. 203-214, Mar. 2008.

Qi, Yingyong "Temporal and Spectral Estimations of Harmonics-to-Noise Ratio in Human Voice Signals" J. Acoust. Soc. Am, Jul. 1997, pp. 537-543.

Lin, Z. et al "Instant Noise Estimation Using Fourier Transform of AMDF and Variable Start Minima Search" IEEE International Conference on Acoustics, Speech, and Signal Processing, vol. 1, Mar. 18-23, 2005, pp. 161-164.

Murphy, P. et al "Noise Estimation in Voice Signals Using Short-Term Cepstral Analysis" J. Acoustical Soc. AM, Mar. 2007, pp. 1679-1690.

* cited by examiner

DETERMINING A HARMONICITY MEASURE FOR VOICE PROCESSING

CROSS-REFERENCE TO RELATED APPLICATIONS

The present application claims priority to U.S. patent application Ser. No. 61/614,525, filed 23 Mar. 2012, the contents of which are incorporated herein by reference.

FIELD OF THE INVENTION

The present disclosure relates generally to processing of audio signals.

BACKGROUND OF THE INVENTION

Voice processing is used in many modern electronic devices, including, without limitation, mobile telephones, headsets, tablet computers, home theatre, electronic games, streaming, and so forth.

Harmonicity of a signal is a measure of the degree of acoustic periodicity, e.g., expressed as a deviation of the spectrum of the signal from a perfectly harmonic spectrum. A measure of harmonicity at a particular time or for a block of samples of an audio signal representing a segment of time of the audio signal is a useful feature for the detection of voice activity and for other aspects of voice processing. While not all speech is harmonic or periodic, e.g., sections of unvoiced phonemes are articulated without the vibration of the vocal cords, the presence of at least some harmonic content is an indicator of vocal communication in most languages. In contrast, many undesirable audio signals other than voice, e.g., noise are inharmonic in that they do not contain harmonic components. Hence, a measure of harmonicity is particularly useful as a feature indicative of the presence of voice.

One measure of harmonicity is the Harmonics-to-Noise Ratio (HNR). Another is the Subharmonic-to-Harmonic Ratio (SHR).

DESCRIPTION OF EXAMPLE EMBODIMENTS

Figure 1:
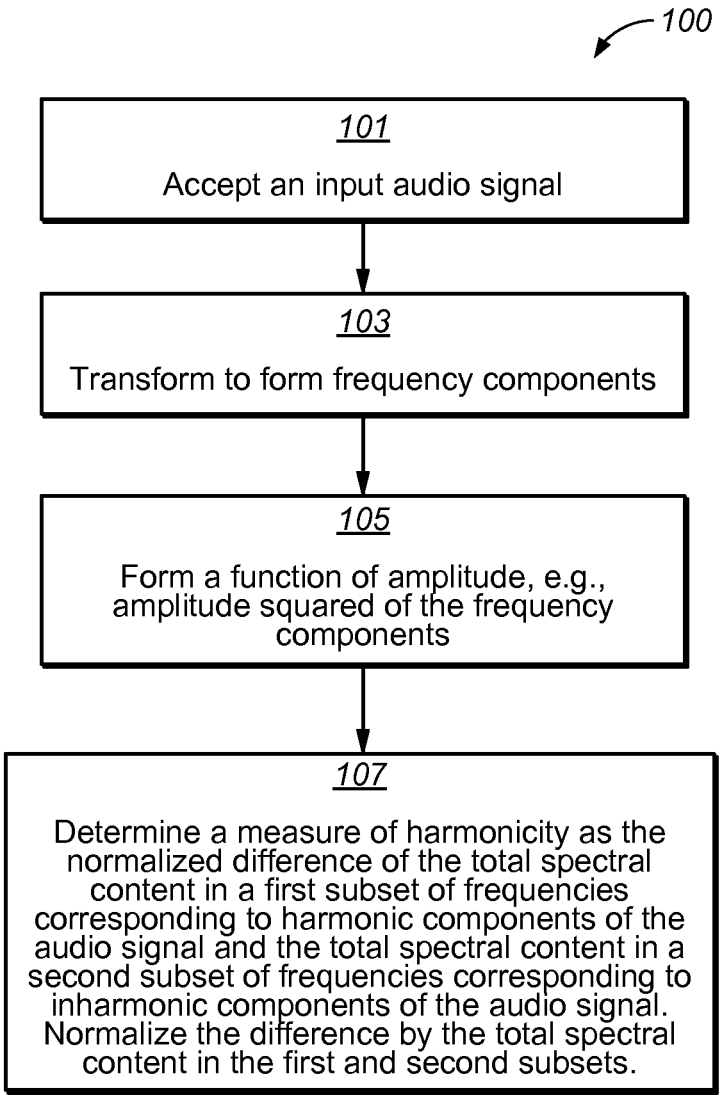
FIG. 1 shows a flowchart of an example embodiment of a method of forming a harmonicity measure.

Reference will now be made in detail to several embodiments, examples of which are illustrated in the accompanying drawings. It is noted that wherever practicable similar or like reference numbers may be used in the drawings and may indicate similar or like functionality. The drawings depict embodiments of the disclosed system (or method) for purposes of illustration only. One skilled in the art will readily recognize from the following description that alternative embodiments of the structures and methods illustrated herein may be used without departing from the principles described herein.

Overview

Embodiments of the present invention includes a method, an apparatus, logic to carry out a method, and a computer-readable medium configured with instructions that when executed carry out the method. The method is for determining a measure of harmonicity determined from an audio signal and useful for voice processing, e.g., for voice activity detection and other types of voice processing. The measure rewards harmonic content, and is reduced by inharmonic content.

The measure of harmonicity is applicable to voice processing, for example for voice activity detection and a voice activity detector (VAD). Such voice processing is used for noise reduction, and the suppression of other undesired signals, such as echoes. Such voice processing is also useful in in levelling of program material in order for the voice content to be normalized, as in dialogue normalization.

One embodiment includes a method of operating a processing apparatus to determine a measure of harmonicity of an audio signal. The method comprises accepting the audio signal and determining a spectrum of an amplitude measure for a set of frequencies, including time-to-frequency transforming the signal to form a set of frequency components of the signal at the set of frequencies. The method further comprises determining as a measure of harmonicity a quantity indicative of the normalized difference of the total spectral content in a first subset of frequencies corresponding to harmonic components of the audio signal and the total spectral content in a second subset of frequencies corresponding to inharmonic components of the audio signal, the difference normalized by the total spectral content in the first and second subsets. Each total spectral content is up to a maximum frequency and based on the amplitude measure.

In some embodiments, the time-to-frequency transforming performs a discrete Fourier transform of a time frame of samples of the audio input signal, such that the set of frequencies are a set of frequency bins, and the amplitude measure is the square of the amplitude.

In some embodiments, whether or not a frequency is in the first or second subset is indicated by a mask defined over frequencies that include the first and second subsets. The mask has a positive value for each frequency in the first subset and a negative value for each frequency in the second subset. Determining of the measure of harmonicity includes determining the sum over the frequencies of the product of the mask and an amplitude measure.

In some such embodiments, determining the difference comprises: determining one or more candidate fundamental frequencies in a range of frequencies. Each candidate fundamental frequency has an associated mask. Determining the difference further comprises obtaining the one or more associated masks for the one or more candidate fundamental frequencies by selecting the one or more associated masks from a set of pre-calculate masks, or by determining the one or more associated masks for the one or more candidate fundamental frequencies. Determining the difference further comprises calculating a candidate measure of harmonicity for the one or more candidate fundamental frequencies, and selecting the maximum measure of harmonicity as the measure of harmonicity.

Particular embodiments include a tangible computer-readable storage medium comprising instructions that when executed by one or more processors of a processing system cause processing hardware to carry out a method of determining a measure of harmonicity for an input signal as recited above.

Particular embodiments include program logic that when executed by at least one processor causes carrying out a method a method of determining a measure of harmonicity for an input signal as recited above.

Particular embodiments include an apparatus comprising one or more processors and a storage element, the storage element comprising instructions that when executed by at least one of the one or more processors cause the apparatus to carry out a method of determining a measure of harmonicity for an input signal as recited above.

Particular embodiments include an apparatus to determine a measure of harmonicity of an audio signal. The apparatus comprises a spectrum calculator operative to accept the audio signal and calculate a spectrum of an amplitude measure for a set of frequencies. The spectrum calculator includes a transformer to time-to-frequency transform the signal. The apparatus further comprises a fundamental frequency selector operative to determine a candidate fundamental frequency in a range of frequencies; a mask determining element coupled to the fundamental frequency selector and operative to retrieve or calculate an associated mask for the candidate fundamental frequency; a harmonicity measure calculator operative to determine a measure of harmonicity for the candidate fundamental frequency by determining the sum over the set of frequencies up to a maximum frequency of the product of the associated mask and the amplitude measure, divided by the sum over the set of frequencies up to the maximum frequency of the amplitude measure; and a maximum selector operative to select the maximum of candidate harmonicity measures determined by the harmonicity measure calculator for candidate fundamental frequencies in the range of frequencies.

In some embodiments, the fundamental frequency selector selects each frequency bin in the range of frequencies. In some such embodiments, the fundamental frequency selector is operative on an amplitude measure spectrum oversampled in frequency to obtain the candidate fundamental frequencies over a finer frequency resolution than provided by the time-to-frequency transform. In some such embodiment, the apparatus further comprises a storage element storing a data structure of pre-calculate masks, and a plurality of harmonicity measure elements, each comprising: a mask determining element coupled to the storage element and operative to retrieve an associated mask one of the frequency bins in the range of frequencies; and a harmonicity measure calculator to determine a measure of harmonicity using the associated mask retrieved by the mask determining element. The harmonicity measure forming elements operate in parallel.

In some embodiments, the fundamental frequency selector comprises a peak detector to detect peaks in the amplitude measure spectrum of the signal.

Particular embodiments may provide all, some, or none of these aspects, features, or advantages. Particular embodiments may provide one or more other aspects, features, or advantages, one or more of which may be readily apparent to a person skilled in the art from the figures, descriptions, and claims herein.

Description of Some Embodiments

Voice processing is used in many modern electronic devices, including, without limitation, mobile telephones, headsets, tablet computers, electronic games that include voice input, and so forth. In voice processing, it is often desirable to determine a signal indicative of the presence or not of noise. A measure of harmonicity is particularly useful as such a feature indicative of the presence of voice.

FIG. 1 shows a flowchart of an example embodiment of a method of processing of a set of samples of an input audio signal, e.g., a microphone signal. The processing is of blocks of M samples of the input audio signal. Each block represents a segment of time of the input audio signal. The blocks may be overlapping as is common in the art. The method includes in 101 accepting the sampled input audio signal, in 103 transforming from time to frequency to form frequency components, and in 105 forming the spectrum of a function of the amplitude, called the "amplitude measure" spectrum of the input audio signal for a set of frequencies. The amplitude measure spectrum, i.e., the spectrum of the function of amplitude represents the spectral content. In one set of embodiments of the present invention described herein, the amplitude measure is the square of the amplitude, so that the sum of the amplitude measure over a frequency range is a measure of energy in the signal in the frequency range. However, the invention is not limited to using the square of the amplitude. Rather, any monotonic function of the amplitude can be used as the amplitude measure. For example, the amplitude measure can be the amplitude itself. Such an amplitude spectrum is sometimes referred to as spectral envelope. Thus, rather than energy in a frequency range, terms such as "the total spectral content in a frequency range" and "the total spectral content based in the amplitude measure in a frequency range" are sometimes used herein.

In one embodiment, the transforming of step 103 implements a short time Fourier transform (STFT). For computational efficiency, the transformer uses a discrete finite length Fourier transform (DFT) implemented by a fast Fourier transform (FFT) to transforms the samples of a block into frequency bins. Other embodiments use different transforms. Embodiments of 103 also may include windowing the input samples prior to the time-to-frequency transforming in a manner commonly used in the art. In other embodiments the transform may be an efficient transform for coding such as the modified discrete cosine transform (MDCT). For transforms such as the MDCT, it may be necessary to apply regularization in step 103 to obtain a robust spectral estimate. One such regularization process used with the MDCT is often referred to as creating a "pseudo spectrum" and would be known to those skilled in the art. See, e.g., Laurent Daudet and Mark Sandler, "MDCT Analysis of Sinusoids: Exact Results and Applications to Coding Artifacts Reduction," IEEE Transactions on Speech And Audio Processing, Vol. ASSP-12, No. 3, May 2004, pp. 302-312.

One embodiment uses a block size of 20 ms of samples of the input signal, corresponding to a frequency bin resolution of around 50 Hz. Other block sizes may be used in alternate embodiments, e.g., a block size of between 5 ms and 260 ms. In one embodiment, the signal is sampled at a sampling rate of 16 kHz. Other sampling rates, of course, may be used.

The method further includes in 107 determining as a measure of harmonicity a quantity indicative of the normalized difference of the total spectral content, based on the amplitude measure, in a first subset of frequencies corresponding to harmonic components of the audio signal and the total spectral content, based on the amplitude measure, in a second subset of frequencies corresponding to inharmonic components of the audio signal, the difference normalized by the total spectral content based on the amplitude measure in the first and second subsets. In some embodiments, the spectral content is calculated up to a pre-defined cutoff frequency rather than over the whole frequency range provided by the time-to-frequency transforming.

From here on, without limiting the invention to such a function of energy, the description will be for the case of the amplitude measure being the square of the amplitude, and the frequencies being frequency bins, so that step in 107 includes determining as a measure of harmonicity a quantity indicative of the normalized difference of the total energy in a first subset of frequency bins corresponding to the harmonic components of the audio signal and the total energy in a second subset of frequency bins corresponding to the inharmonic components of the audio signal. The difference is normalized by the total energy of the signal in the first and second subsets.

Different embodiments use different methods to carry out step 107.

Some embodiments of the method use a mask to indicate whether a particular frequency bin is in the first or in the second subset, i.e., whether a particular frequency bin is in the harmonic content or in the inharmonic content of the signal. The total content can be determined by summing over a range of frequency bins the product of the amplitude squared (in general, the function of amplitude of step 105) and the mask. The range of frequency bins includes the first and second subsets. The range such summation may be all frequencies, or a subset of the frequencies up to the pre-defined cutoff frequency.

In some embodiments, the mask has a positive value for each frequency in the first subset and a negative value for each frequency in the second subset, such that the determining of the measure of harmonicity includes determining the sum over the range of frequency bins of the product of the mask and the amplitude measure. One set of embodiments uses a binary valued mask, e.g., a mask that is +1 for a frequency bin that is part of the harmonic content, and a mask that −1 for a frequency bin is part of the inharmonic content.

Figure 2:
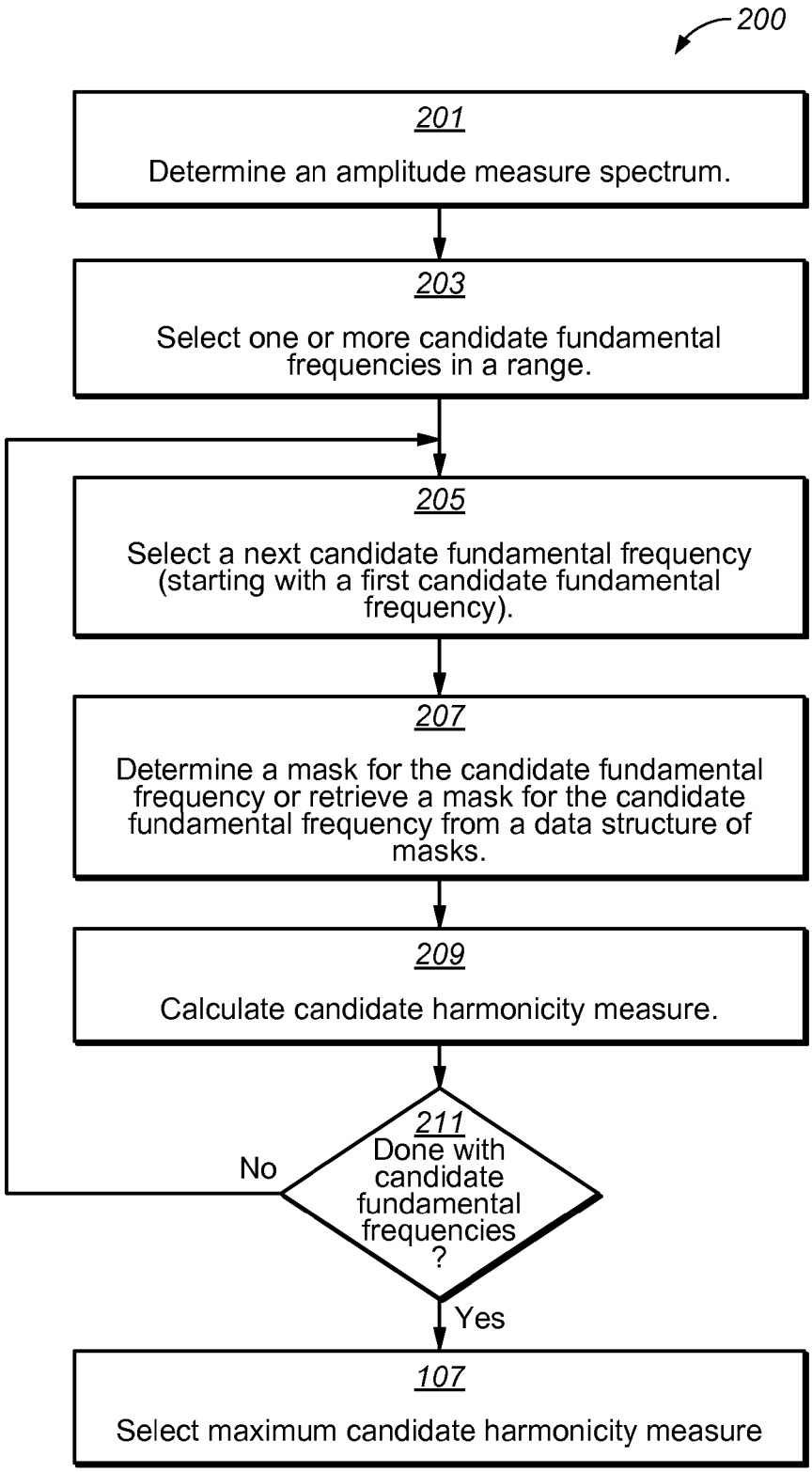
FIG. 2 shows a simplified flowchart of a method embodiment of the invention that uses masks.

FIG. 2 shows a simplified flowchart of a method embodiment of the invention that uses masks, and that includes, in 201, steps 101, 103, 105 to determine an amplitude measure spectrum, e.g., a spectrum of the square of the amplitude. In 203, the method includes selecting one or more, typically a plurality of candidate fundamental frequencies in a range of possible fundamental frequencies. Denote such a candidate fundamental frequency by $f_0$ and denote the range of possible fundamental frequencies by $[f_{0\ min}, \ldots, f_{0\ max},]$. Each candidate fundamental frequency $f_0$ has an associated mask. In general, if a frequency $f_0$ is a fundamental frequency, it is expected that frequencies in a vicinity of $f_0$ would also be part of the harmonic content. Furthermore, there would be harmonics of the fundamental frequencies at or near multiples of $f_0$, e.g., at or near frequencies $kf_0$ for k=1, 2, . . . K, where K is the maximum harmonic for the frequency range for which the harmonicity measure is determined. In some embodiments of the invention, the number of harmonics of each $f_0$ is limited to cover frequencies up to a pre-defined cutoff frequency. One embodiment uses a cutoff frequency of 4 kHz. Embodiments of the invention include in steps 205, 207, 209, and 211 determining a candidate harmonicity measure for each candidate fundamental frequency using the mask associated with the candidate fundamental frequency. One embodiment includes in 205, selecting a next candidate fundamental frequency, with the next candidate fundamental frequency being a first candidate fundamental frequency the first time 205 is executed. The method includes in 207 determining a mask for the candidate fundamental frequency or retrieving a mask for the candidate fundamental frequency from a data structure of masks, and in 209 calculating a candidate measure of harmonicity. 211 includes determining if all candidate fundamental frequencies in the range of possible fundamental frequencies have been processed. If not, the method selects and processed the next candidate fundamental frequency starting in 205. When all candidate fundamental frequencies have been processed, the method in 213 selects as the measure of harmonicity the maximum of the candidate fundamental frequencies.

Thus, some embodiments include determining a candidate harmonicity measure for a set of candidate fundamental frequencies using the masks associated with the candidate fundamental frequencies. If the set includes only a single candidate fundamental frequency, it is regarded as the fundamental frequency, and the harmonicity measure for the signal is determined for the mask associated with the single fundamental frequency. If the set includes more than one candidate fundamental frequency, the harmonicity measure for the signal is determined as the maximum of the candidate harmonicity measures.

Some embodiments include in 203 selecting every frequency in the range $[f_{0\ min}, \ldots, f_{0\ max},]$ as a candidate fundamental frequency $f_0$. This selecting is in some embodiment preceded by oversampling to obtain a finer frequency resolution. We call such embodiments "brute force." The brute force method lends itself well to parallel implementations in which steps 205 through 211 are replaced by carrying out, for each candidate fundamental frequency, a mask for the candidate fundamental frequency from a data structure of masks, and calculating the candidate harmonicity measure. The steps can be carried out for the candidate fundamental frequencies in parallel.

Other embodiments of the invention include for step 203 determining one or more locations of peaks in the amplitude measure, e.g., in the amplitude of the frequency components or the square of the amplitude of the frequency components in corresponding to $[f_{0\ min}, \ldots, f_{0\ max},]$ as candidate fundamental frequencies. We call such embodiments "peak detection" embodiments.

The Measure of Harmonicity

Embodiments that use a mask include, for each of a set of candidate fundamental frequencies, using the mask of a candidate fundamental frequency to calculate a candidate measure of harmonicity. The measure of harmonicity output by the method or apparatus is the maximum of the candidate measures of harmonicity.

Index m is used to indicate the mask associate with the m'th candidate fundamental frequency. The mask is defined by a set of weights $w_{m,n}$ for the mask index m and the frequency bins n within the range of frequency bins for which the mask is used to determine a candidate measure of harmonicity. Let there be N' frequency indices in the range of frequencies for which the measure of harmonicity is calculated up to the pre-defined cutoff frequency. The mask is then defined by $w_{m,n}$, n=0, . . . , N'−1.

In embodiments of the invention, the total content can be determined by summing over a range of frequency bins the product of the amplitude squared (or in general, the amplitude measure of step 105) and the mask. The range of frequency bins includes the first subset where the mask indicated harmonic content and the second subset where the mask indicates inharmonic content. The range such summation may be all frequencies, or a subset of the frequencies up to the pre-defined cutoff frequency. For a candidate fundamental frequency, denoted $f_0$, the approximate harmonic locations k $f_0$ are considered for k=1, . . . , K. The inventors have found that in voice signals, the higher frequencies may be noisy, so that the higher harmonics may be dominated by inharmonic noise. Some embodiments of the invention only consider a finite, relatively small number of harmonics within the transform frequency range. That is, K is a relatively small number. In one embodiment K=8. Other embodiments use values of K between 2 and 16.

Consider as an example an embodiment that considers candidate fundamental frequencies in the range [50 Hz, 400 Hz]. The maximum harmonic frequency is 3.2 kHz for K=8. Allowing for a small window of, e.g., width $f_0/4$ around each possible harmonic would have a maximum frequency bin at 3250 Hz.

Thus in some embodiments, the masks are only populated and computed for a subset of the frequency bins. In one set of embodiments, a pre-defined cutoff frequency of 4 kHz is used, represented by the index n value N'. In such embodiments, the mask is determined only for those frequency bins up to the cutoff frequency. Other embodiments use a cutoff frequency in the range of 2 kHz to 12 kHz, and start at a value of n>0, e.g., bins $n=N_1$ to $n=N_2$, where $N_2=N'-1$.

In general, the value of the mask elements may be defined to be in the range $-1 \le w_{m,n} \le 1$ (or more generally, $-\alpha \le w_{m,n} \le \alpha$, α positive) in order to weigh different frequency locations differently. In some embodiments of the invention, the $w_{m,n}$ take on only two possible values, +1 for a frequency bin in the first subset where there harmonic content, and −1 for a frequency bin in second subset where there inharmonic content. In one embodiment, all frequency other than those of the first subset are considered in the second subset, such that $w_{m,n}=\pm 1$ for all m and n. This allows for rapid calculation of each candidate measure of harmonicity by additions. In an alternate set of embodiments, $w_{m,n}$ has values selected from {−1, 0, 1} for all m and n to allow for selected bins to be excluded by the mask.

The candidate measure of harmonicity for the m'th candidate fundamental frequency is denoted by $H_m$ and defined to be the sum over the range of frequencies of the mask-weighted amplitude measure (e.g., square of the amplitude) normalized by the sum over the range of frequencies of amplitude measure, e.g., square of the amplitude, which is the total energy in the range of frequencies. That is, in one embodiment, $$H_m = \frac{\sum_{n=0}^{N'-1} w_{m,n} |X_n|^2}{\sum_{n=0}^{N''-1} |X_n|^2},$$

where $X_n$, n=1, . . . , N'−1 represents the transform coefficients of a block of samples of the input signal up to the pre-defined cutoff frequency, e.g., the index for 4 kHz. and $H_m$ is the measure calculated for specific mask window m, and $w_{m,n}$, n=0, . . . , N'−1 represents the mask m.

In an alternate embodiment, $$H_m = \frac{\sum_{n=0}^{N'-1} w_{m,n} |X_n|}{\sum_{n=0}^{N'-1} |X_n|}.$$

One property of the measure of harmonicity used in embodiments of the present invention is that the measure is invariant to scaling of the input signal. This is a desirable property may voice processing applications.

Embodiments of the method include determining $H_m$ for all candidate fundamental frequencies, and selecting as the measure of harmonicity, denoted H, the maximum of the determined $H_m$'s.

One embodiment further provides as output the determined fundamental frequency, denoted $\hat{f}_0$ that generated the measure of harmonicity H. This fundamental frequency $\hat{f}_0$ may not be as accurate as one could obtain by some other methods specifically for pitch determination, but can still a useful feature for voice processing without using a method specifically designed for pitch estimation.

Peak Detection Embodiments

One set of embodiments includes using a peak detection method to detect one or more peaks in the amplitude measure spectrum, e.g., amplitude spectrum or amplitude squared spectrum, in a range of possible fundamental frequencies, and to select the detected peaks as candidate fundamental frequencies. Some such embodiments include interpolating or oversampling between frequency bin locations to determine the peak location more accurately to use as a candidate fundamental frequency. There is a mask associated with each candidate fundamental frequency. In the embodiments that include peak detection, some versions assume that the harmonics of a fundamental frequency are exactly at an integer multiple of the fundamental frequency. Such masks are called fixed masks. Other versions assume that the harmonics may not be exactly at, but may be in a region near an integer multiple of the fundamental frequency. In such versions, embodiments of the invention include carrying out peak detection in the neighbourhood of each possible location in frequency of a harmonic of a fundamental frequency. Once such a peak is found, some embodiments include interpolating or oversampling between bin locations to determine the peak location more accurately, and include creating elements of the mask near the determined peak location as a location of a harmonic. The resulting masks are called dynamic masks.

Picking Peaks as Candidate Fundamental Frequencies

While many peak detection methods are known, one embodiment simply determines the location of maxima in the amplitude spectrum. Another method makes use of the fact that the first derivative of a peak has a downward-going zero-crossing at the peak maximum, so looks for zero crossings in the first derivative of the amplitude spectrum (or amplitude measure spectrum). The presence of random noise in actual data may cause many false zero-crossing. One embodiment includes smoothing the first derivative of the amplitude spectrum before searching for downward-going zero-crossings, and selects only those (smoothed) zero crossings whose slope amplitude exceeds a pre-determined slope threshold and only frequency bins where the amplitude spectrum exceeds a pre-determined amplitude threshold. To further improve the frequency resolution of peak detection, some embodiments include curve fitting, e.g., parabolic curve fitting or least squares curve fitting around the detected peak to refine the peak location. That is, in some embodiments, the peak is determined at a resolution that is finer than the frequency resolution of the time-to-frequency transform, i.e., that can be between frequency bin locations. One method embodiment of obtaining such a finer resolution uses interpolation.

One embodiment uses quadratic interpolation around the three bins that include the detected peak location and the two immediate neighbors, and determines the location of the maximum between the bin frequencies. Suppose the initial detected maximum is at frequency index no, and the preceding and following frequency bins are at indices $n_0-1$ and $n_0+1$. Denote by $A(n_0)$, $A(n_0-1)$ and $A(n_0+1)$ the amplitude measures at these three frequency bins. With three point 3 point quadratic interpolation, the analytic maximum of the amplitude measures is at a fraction of a bin denoted $\delta n_0$ in the range $|\delta n_0| \leq 1/2$, with $$\delta n_0 = \frac{1}{2}\frac{A(n_0-1)-A(n_0+1)}{A(n_0-1)-2A(n_0)+A(n_0+1)}.$$

Another embodiment includes oversampling the frequency domain to sub-frequency bins to increase the frequency resolution. In one embodiment, oversampling in the frequency domain is carried out by padding with zero-valued samples in the time domain. In another embodiment, the oversampling to a finer frequency resolution is carried out by interpolation of the amplitude spectrum (or more generally, the magnitude measure spectrum) to obtain the additional frequency points in between the frequency bins of the time-to-frequency transformer. One embodiment uses linear interpolation for the in between (sub-frequency bin) data points. Another embodiment uses spline interpolation for the in between data points. by zero-padding in the time domain.

An error in estimating the fundamental frequency $f_0$ translates to larger errors for the higher harmonics of the fundamental frequency. Hence, errors in detecting peaks at the low frequencies of the range may cause errors in determining the location of harmonics. In some embodiments, e.g., in which the resolution of the transform makes it difficult to accurately determine a fundamental frequency at the relatively low frequencies, when a peak is detected at a frequency, e.g., at frequency $f_0$ that is higher than a pre-defined minimum frequency, the method further includes assuming that there is a fundamental frequency at a fraction, e.g., 1/p of the detected peak location, i.e., at the frequency $f_0/p$. The pre-defined minimum frequency is selected to be the frequency below which a candidate fundamental frequency that is 1/p of the detected peak location could not reasonably relate to a voiced signal. In one embodiment, it is assumed that is it not likely for a fundamental frequency below 75 Hz to relate to a voiced signal. Thus, for an example 1/p value of ½, the pre-defined minimum frequency is 150 Hz, and so that if a peak is detected at a frequency $f_0$>150 Hz, it is assumed there is a candidate fundamental frequency at at the frequency $f_0/2$, and a mask is looked up or calculated, and used to determine a candidate harmonicity measure for such a candidate fundamental frequency.

Thus, in some embodiments, for the low first fundamental frequency, the method comprises searching for peaks near a multiple of, e.g., 2 times the low fundamental frequency, and determining the location of the multiple of the low fundamental frequency, and dividing the location by the multiple, e.g., by 2, to obtain an improved estimate of the low first fundamental frequency.

Dynamic Masking

One embodiment of a method of masking and determining harmonicity we call dynamic masking includes, for each candidate fundamental frequency, searching for peak frequency locations in the amplitude measure (or amplitude) frequency domain data near harmonics of the fundamental frequency.

The method includes using peak detection to select approximate candidate $f_0$ locations as bin values corresponding to peaks in the amplitude measure (or amplitude) frequency domain data. A range of possible fundamental frequency location is used, e.g., a range between $f_{0min}$ and $f_{0max}$. In one embodiment, the range is 50 to 300 Hz, in another, the fundamental frequency is assumed to be in the range (0, 400 Hz].

While in some embodiments, the candidate $f_0$ is set to be approximate candidate $f_0$ location, one embodiment of dynamic masking includes, for an approximate candidate $f_0$ location, oversampling or interpolating to determine the corresponding candidate $f_0$.

For each candidate $f_0$, the method includes creating a mask of width $2rf_0$ in frequency at each harmonic location in a range of frequencies, where in one embodiment, r=1/8, and in two alternate embodiments r=1/16 and r=3/16, respectively.

Creating the mask at the harmonics of candidate $f_0$ location includes, in a range harmonics denoted by k, k=1, . . . , K, searching for a peak in the region of discrete bins covered by the frequency range $[(k-r)f_0, (k+r)f_0]$, where r is half the mask width. In one embodiment, once a peak bin location is found, the method includes oversampling or interpolating to determine the corresponding candidate harmonic location of $kf_0$ and identifying mask bin locations for harmonic k on a bin region of width $2rf_0$ in frequency centred on the identified peak location.

Creating the mask for the candidate $f_0$ location includes setting each mask element to +1 at the identified mask bin locations for the regions around the harmonic locations of $f_0$, and setting all other mask elements to −1.

The dynamic masking method further includes determining a candidate harmonicity measure for each candidate $f_0$. The method further includes selecting as the harmonicity measure of the signal the maximum candidate harmonicity measure.

Some embodiments of the dynamic masking method described herein includes, for the low first or first and second fundamental frequency, searching for peaks near multiples of a fundamental frequency, e.g. twice the fundamental frequency, and using the higher harmonic determined by peak detection (with refinement to a finer resolution) to refine the (low) fundamental frequency by dividing the determined location by the order of the harmonic, e.g., dividing by 2 to determine an improved fundamental frequency.

Fixed Masking

Another embodiment of a method of masking and determining harmonicity we call fixed masking includes assuming a fixed location for the harmonics of each candidate of the fundamental frequency.

The method includes selecting approximate candidate $f_0$ locations as bin values corresponding to detected peaks the amplitude measure (amplitude squared, or amplitude) frequency domain data located in the range $[f_{0min}, f_{0max}]$, e.g., [50 Hz, 300 Hz] in one version, and (0, 400 Hz] in another version.

While in some embodiments, the candidate $f_0$ is set to be an approximate candidate $f_0$ location, one embodiment of fixed masking includes, for an approximate candidate $f_0$ location, oversampling or interpolating to determine the corresponding candidate $f_0$.

For each candidate $f_0$, the method includes setting the values of the mask to +1 at all frequency bins with a width of $2rf_0$ in frequency around $kf_0$, that is, in the range $[(k-r)f_0, (k+r)f_0]$ for k=1, . . . , K, and setting the mask to −1 at all other bin locations of the mask. In one embodiment, r=⅛, and in two alternate embodiments r=−1/16 and r=3/16, respectively.

The fixed masking method further includes determining a candidate harmonicity measure for each considered candidate $f_0$. The method further includes selecting as the harmonicity measure of the signal the maximum candidate harmonicity measure.

Oversampled Fundamental Frequency Fixed Masking

Another peak detection embodiment of a method of masking and determining harmonicity we call "oversampled fundamental frequency fixed masking" includes oversampling the frequency bins by an oversampling factor denoted S for the range of frequencies between $f_{0min}$ and $f_{0max}$. In one embodiment, S=4. Alternate embodiments use an oversampling factor S of up to 16. The oversampling is carried out by interpolating the frequency domain amplitude measure for the in between oversampled points. One embodiment uses linear interpolation to determine the oversampled amplitude measures. Another embodiment uses zero padding in the time domain to achieve oversampling in the frequency domain.

The method includes peak detection to select candidate $f_0$ locations as peak locations in the oversampled data. The method further includes, for each $f_0$ candidate, computing the associated mask or selecting the associated mask from a data structure, e.g., a table of pre-calculated masks, and determining a candidate harmonicity measure for each considered candidate $f_0$. The method further includes selecting as the harmonicity measure of the signal the maximum candidate harmonicity measure.

Brute Force

Another embodiment of a method of masking and determining harmonicity we call "brute force." In the brute force method, no peak detection is carried out. Rather, each frequency in the range $[f_{0min}, f_{0max}]$ is regarded as a fundamental frequency candidate. In one embodiment, the frequency domain data is S times oversampled, e.g., using an interpolation method, or, in another version, using zero padding in the time domain. For each frequency (such frequency being an $f_0$ candidate), the method includes computing a mask or selecting a mask from a table of associated masks. The method further includes determining a candidate harmonicity measure for each considered candidate $f_0$, and selecting as the harmonicity measure of the signal the maximum candidate harmonicity measure.

Computational Complexity

One feature of embodiments of the invention that use masks that have values ±1 is that a candidate measure of harmonicity can be determined from a spectrum of the amplitude measure using only a set of additions and a single divide. The dynamic masking embodiments do have increased computational complexity over those using fixed masks, but still remain favorable on many computing platforms.

Pre-computing Masks

Under the assumption that for each candidate fundamental frequency $f_0$, there are harmonics at frequencies $kf_0$, k=1, . . . , K, one can pre-compute a mask for each possible candidate fundamental frequency $f_0$, and store the mask for later retrieval when needed. In one embodiment, each harmonic location $kf_0$, k=1, . . . , K is assumed to contain harmonic content within a window of width $2rf_0$ in frequency around frequency $kf_0$, that is, in the range $[(k-r)f_0, (k-r)f_0]$ for k=1, . . . , K, and pre-calculating the mask for a candidate fundamental frequency $f_0$ sets the mask values to a positive value, e.g., +1 for all the bin locations. In one embodiment K is selected so that the mask is limited to a pre-defined cutoff frequency of 4 kHz. In one embodiment, r=⅛. Other embodiments use r=1/16 and r=3/16. One embodiment of the invention includes storing all the masks for different candidate fundamental frequency $f_0$ values in a data structure, e.g., a table, so that the table can be looked up and a pre-calculated mask retrieved. Other data structures are possible for storing masks, as would be clear to those skilled in the art. Using a data structure for pre-calculated masks uses memory for mask storage to save computational time that would otherwise be required to determine a mask on the fly for a candidate fundamental frequency. The number of pre-determined masks depends on the frequency bin spacing across the range of fundamental frequencies of interest. In one embodiment, frequencies for voice formants are considered in the range of 50 to 400 Hz, with a block size of 20 ms, this corresponds to 8 frequency domain points. Determining the peak can be carried out on a finer resolution than the frequency bin resolution of the transform by oversampling or interpolating the amplitude (or amplitude measure) spectrum across this frequency range. Denote by S an oversampling rate. Some embodiments use S=4. For this oversampling rate, allowing 256 bits per mask, 8 kbits would be needed to store all the masks, which is reasonable in terms of memory allocation. Other embodiments use a value for S of between 1 and 16.

Processing Apparatus Embodiments that use Peak Detection

Figure 3A:
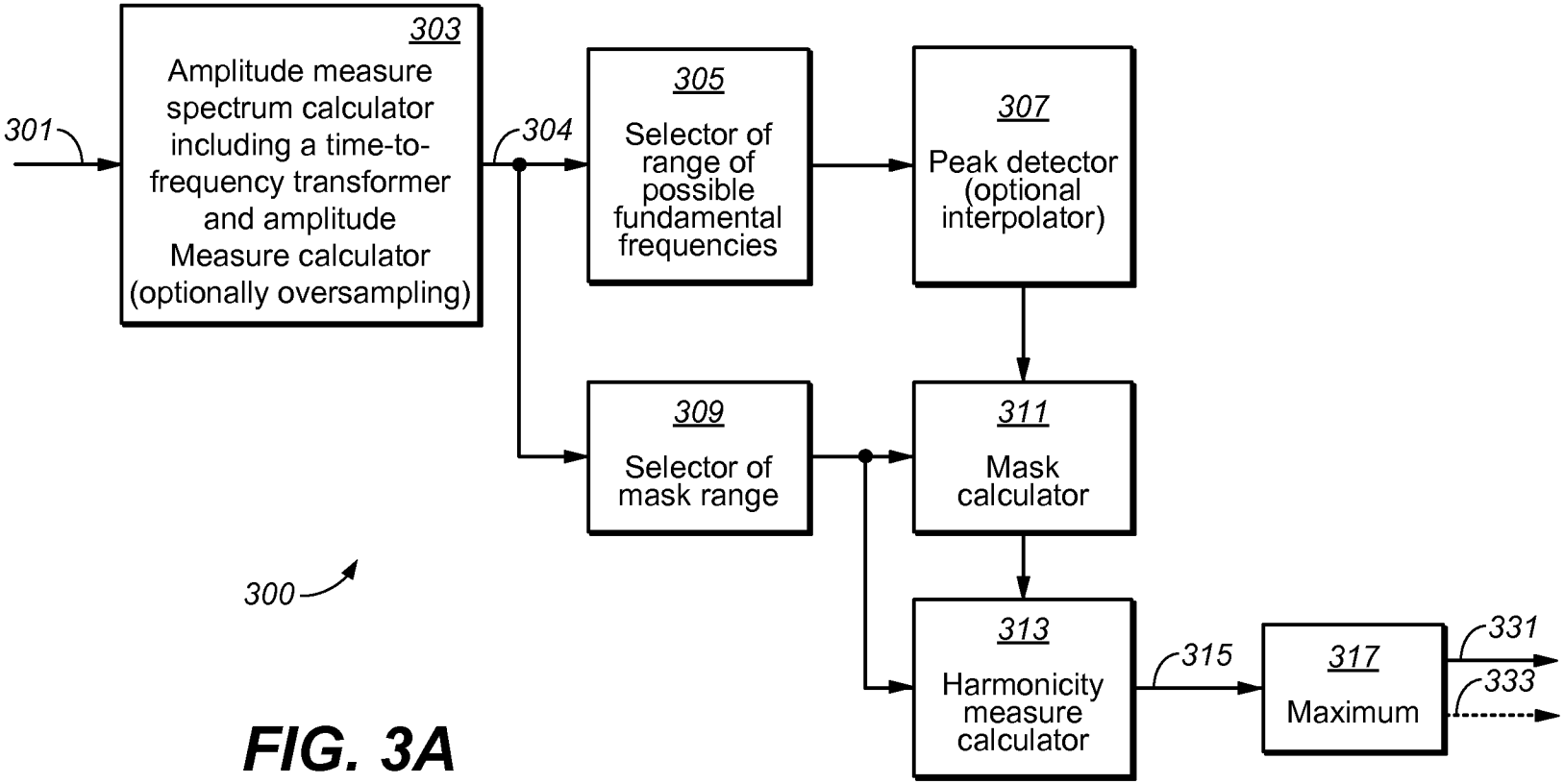
FIG. 3A shows a simplified block diagram of a processing apparatus embodiment of the invention that uses peak detection.

FIG. 3A shows a simplified block diagram of an embodiment of the invention in the form of a processing apparatus 300 that processes a set of samples an input audio signal, e.g., a microphone signals 301 and determines a measure of harmonicity 331. The processing is of blocks of M samples of the input audio signal. Each block represents a segment of time of the input signal. The blocks may be overlapping, e.g., has 50% overlap as is common in the art. Spectrum calculator element 303 accepts sampled input audio signal 301 and forms a frequency domain amplitude measure 304 of the input audio signal 301 for a set of N frequency bins. The amplitude measure represents the spectral content. In one set of embodiments of the present invention described herein, the amplitude measure is the square of the amplitude, so 303 outputs an spectrum of the square of the amplitude whose sum over frequency bins is the energy of the signal. However, the invention is not limited to using the amplitude squared. Element 303 includes a time-to-frequency transformer to transform the samples of a frame into frequency bins. In one embodiment, the transformer implements a short time Fourier transform (STFT). For computational efficiency, the transformer uses a discrete finite length Fourier transform (DFT) implemented by a fast Fourier transform (FFT). Other embodiments use different transforms, e.g., the MDCT with appropriate regularization. Element 303 also may include a window element that windows the input samples prior to the time-to-frequency transforming in a manner commonly used in the art.

Some embodiments use a block size of 20 ms of samples of the input signal, corresponding to a frequency bin resolution of around 50 Hz. Other block sizes may be used in alternate embodiments, e.g., a block size of 5 ms to 260 ms.

In some embodiments, spectrum calculator 303 produces oversampled frequency data, e.g., by zero padding in the time domain, or by interpolating in the frequency domain. Other versions include a separate oversampling element.

Processing apparatus 300 further includes a fundamental frequency selector operative to determine candidate fundamental frequencies in a range of frequencies. In FIG. 3A, the fundamental frequency selector includes a selector 305 of a range of possible fundamental frequencies and a peak detector 307 to determine, using peak detection, candidate fundamental frequencies for which to determine a candidate measure of harmonicity. In one embodiment, element 305 is trivially a parameter in 307 to limit the range of possible fundamental frequencies. In some embodiments, the peak detector includes an interpolator to determine candidate fundamental frequencies at a resolution finer than that of the time-to-frequency transformer. In alternate embodiments, the fundamental frequency selector selects all frequencies in the range as candidate fundamental frequencies.

Processing apparatus 300 further includes a mask determining element coupled to the fundamental frequency selector and operative to retrieve or calculate an associated mask for the candidate fundamental frequency. In the embodiment shown in FIG. 3A, the mask determining element includes a selector 309 of a range of possible frequencies for which the masks and candidate measures of harmonicity are determined and a mask calculator 311 to determine a mask for each candidate fundamental frequency determined by the peak detector 307. Processing apparatus 300 further includes a harmonicity measure calculator 313 to calculate candidate measures of harmonicity 315 for the candidate fundamental frequencies determined by the peak detector 307. In one embodiment, element 309 is trivially a parameter in 307 to limit the range of frequencies for the mask calculator 311 and harmonicity measure calculator 313. Processing apparatus 300 further includes a maximum value selector 317 to select the maximum candidate measure of harmonicity as the measure of harmonicity 331 to output. In some embodiments, the fundamental frequency that generated the maximum measure of harmonicity also is output, shown here as optional output 333, shown in broken line form to indicate not all embodiments have such output. This output can be used as a feature for some applications. For example, it can be of use for further voice processing.

Figure 3B:
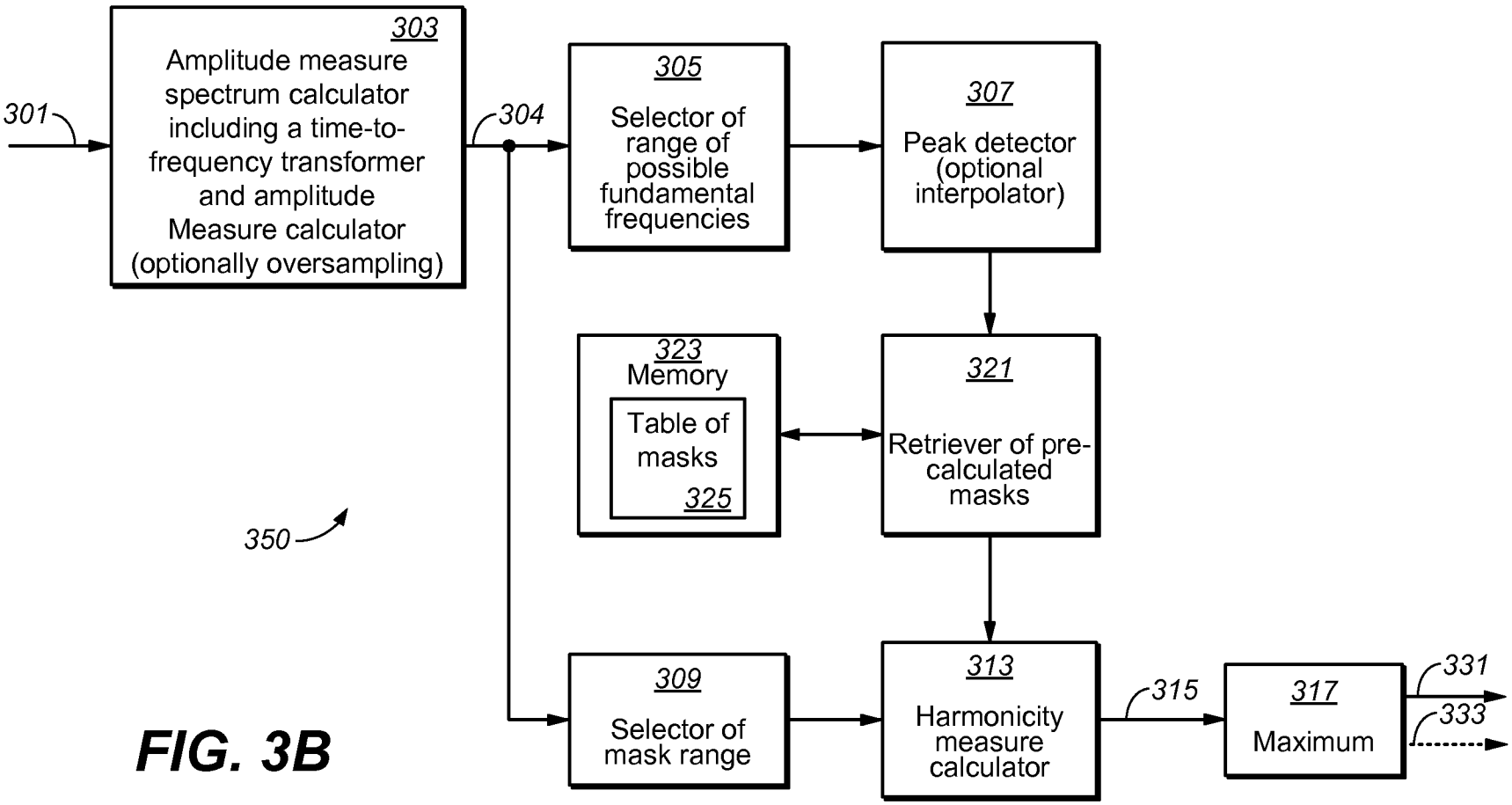
FIG. 3B shows a simplified block diagram of an alternate processing apparatus embodiment of the invention that uses peak detection.

FIG. 3B shows a simplified block diagram of an alternate embodiment of a processing apparatus 350 for determining a measure of harmonicity. In place of the mask calculator 311, processing apparatus 350 uses for the a mask determining element a retriever 321 of pre-calculated masks that is coupled to a memory 323 where a data structure, e.g., a table of pre-calculated masks 325 is stored. Retriever 321 is operative to retrieve a pre-calculated mask for each candidate fundamental frequency determined by the peak detector 307. The harmonicity measure calculator 313 is operative to calculate candidate measures of harmonicity 315 using the retrieved masks for the candidate fundamental frequencies determined by the peak detector 307. Processing apparatus 350 further includes a maximum value selector 317 to select the maximum candidate measure of harmonicity as the measure of harmonicity 331 to output. Some embodiments include as output 333 the fundamental frequency that was used to generate the measure of harmonicity 331, shown in broken line form to indicate not all embodiments have such output.

An Apparatus for Determining Measure using the Brute Force Method

One version of a processing apparatus that uses the brute force method is the same as processing apparatus 300 of FIG. 3A, but rather than using a peak detector, selects all frequencies in the range of selector 305 as candidate fundamental frequencies and calculates a candidate measure of harmonicity for all of the candidate fundamental frequencies, i.e., all frequencies in the range.

Figure 4:
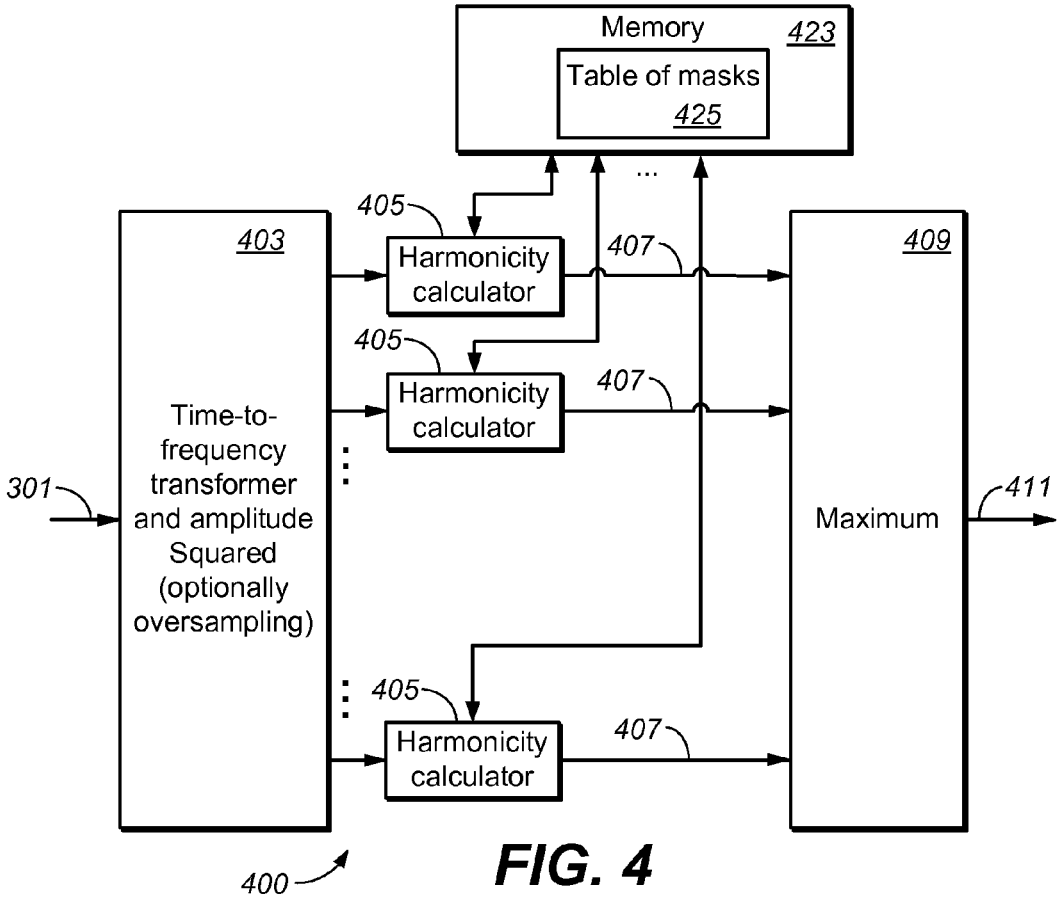
FIG. 4 shows a processing apparatus embodiment of the invention that uses parallel processing.

FIG. 4 shows a processing apparatus embodiment 400 that processes a set of samples an input audio signal, e.g., a microphone signals 301 and determines a measure of harmonicity 331 using the brute force method using parallel processing. Again, the processing is of blocks of M samples of the input signal. Element 403 accepts sampled input audio signal 301 and forms a plurality of outputs, each a frequency domain amplitude measure of the input audio signal 301 at a different one of a set of N' frequency bins. Element 403 includes a time-to-frequency transformer to transform the samples of a frame into frequency bins. In one embodiment, the number of outputs N' covers a subset of the frequency range of the time-to-frequency transformer. The amplitude measure is in one embodiment the square of the amplitude and in another the amplitude for a frequency bin. In some embodiments, element 403 produces oversampled frequency data, e.g., by zero padding in the time domain, or by interpolating in the frequency domain, so that there is a relatively large number of outputs.

Processing apparatus 400 includes a storage element, e.g., a memory 423 that stores a data structure 425, e.g., a table of pre-calculated masks, one for each frequency bin in a range of frequencies bins. Processing apparatus includes a plurality of harmonicity calculators, each coupled one of the outputs of element 403 to be associated with a candidate fundamental frequency, each coupled to the memory 423 and the pre-calculated masks 425 stored therein, and each operative to retrieve the mask associated with its candidate fundamental frequency, and to calculate a candidate measure of harmonicity 407 for the associated candidate fundamental frequency. A maximum selector 409 is operative to select the maximum of the candidate fundamental frequencies 407 and output the maximum as a measure of harmonicity 411 for the input 301. Note that in some embodiments, the fundamental frequency that generated the maximum also is output (not shown in FIG. 4).

Elements 405 are designed to operate in parallel. Thus, an architecture such as processing apparatus 400 is suitable for implementation in logic, or in a processing system in which parallel or vector processing is available.

One or more elements of the various implementations of the apparatus disclosed herein may be implemented as a fixed or programmable arrays of logic elements, such as microprocessors, embedded processors, IP cores, digital signal processors, FPGAs (field-programmable gate arrays), ASSPs (application-specific standard products), and ASICs (application-specific integrated circuits).

A Processing System-based Apparatus

Figure 5:
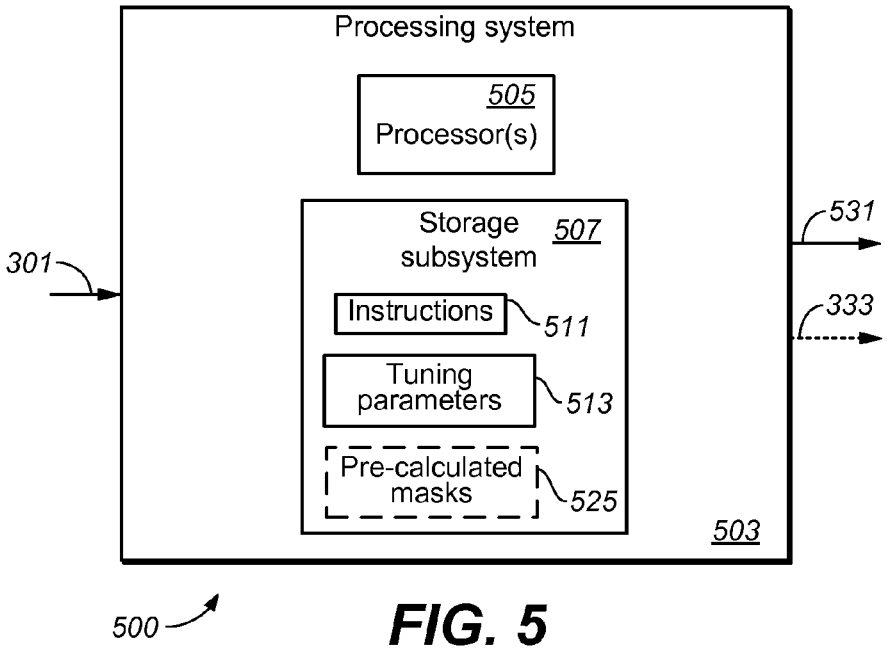
FIG. 5 shows a simplified block diagram of one processing apparatus embodiment that includes one or more processors and a storage subsystem that includes instructions that when executed carry out the steps of a method embodiment.

FIG. 5 shows a simplified block diagram of one processing apparatus embodiment 500 for processing an audio input signal 301, e.g., from a microphone. The processing apparatus 500 is to determine a measure of harmonicity 531. The apparatus, for example, can implement the system shown in one of FIGS. 3A, 3B, and 4, and any alternates thereof, and can carry out, when operating, the methods of FIGS. 1 and 2, including any variations of the method described herein. Such an apparatus may be included, for example, in a headphone set such as a Bluetooth headset or other apparatus that carries out voice processing. The audio input 301 is assumed to be in the form of frames of M samples of sampled data. In the case of analog input, a digitizer including an analog-to-digital converter and quantizer would be present, and how to include such elements would be clear to one skilled in the art.

The embodiment shown in FIG. 5 includes a processing system 503 that is operative in operation to carry out the methods of determining a measure of harmonicity described herein. The processing system 503 includes at least one processor 505, which can be the processing unit(s) of a digital signal processing (DSP) device, or a core or central processing unit (CPU) of a more general purpose processing device. The processing system 503 also includes a storage element, e.g., a storage subsystem 507 typically including one or more memory elements. The elements of the processing system are coupled, e.g., by a bus subsystem or some other interconnection mechanism not shown in FIG. 5. Some of the elements of processing system 503 may be integrated into a single circuit, using techniques commonly known to one skilled in the art.

The storage subsystem 507 includes instructions 511 that when executed by the processor(s) 505, cause carrying one of the methods described herein. Different versions of the instructions carry out different method embodiments described herein, including variations described herein.

In some embodiments, the storage subsystem 507 is operative to store one or more tuning parameters 513, e.g., one or more of oversampling rate (for embodiments that include oversampling), the pre-defined cutoff frequency as the maximum frequency for harmonicity measure calculation, the frequency range for candidate fundamental frequencies, etc., that can be used to vary some of the processing steps carried out by the processing system 503.

For implementations of methods that use pre-calculated masks, the storage subsystem 507 also stores a data-structure 525 of pre-calculated masks. The data structure may be a table or some other suitable data structure. The data structure is shown in FIG. 5 in broken line form to indicate not all embodiments use such a data structure.

Some versions calculate as an output, in addition the measure of harmonicity 531, the frequency bin 533 of the fundamental frequency that generated the measure 531. This output is shown in FIG. 5 in broken line form to indicate not all embodiments have such output.

The system shown in FIG. 5 can be incorporated in a specialized device such as a headset, e.g., a wireless Bluetooth headset. The system also can be part of a general purpose computer, e.g., a personal computer operative to process audio signals.

Example and Performance

Figure 8:
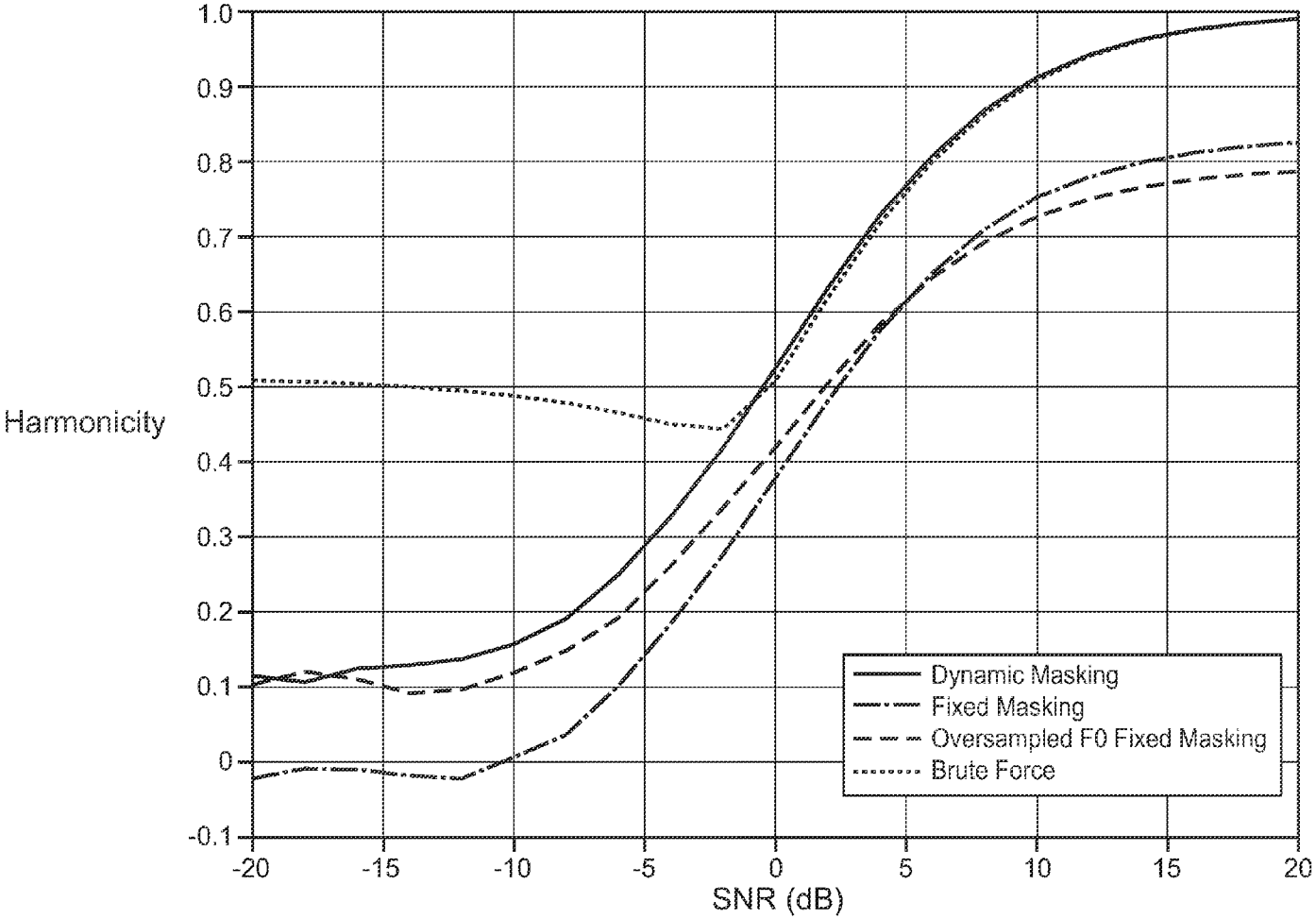
FIG. 8 is a graph showing a comparison of the measure determined by four different embodiments of the present invention.

FIG. 8 shows a comparison of the measure determined by four different embodiments of the present invention: the dynamic masking method, the fixed masking method, the oversampled fundamental frequency fixed masking method, and the brute force method. The harmonicity measure was determined using the square of the amplitude as the amplitude measure. For each variation, a curve shows the value of the measure of harmonicity that was obtained for an input that is a mix of a harmonic signal and an interfering noise. The horizontal axis represents the signal-to-noise ratio being the relative energy in the complete harmonic signal compared to the noise. The harmonic signal was constructed with a fundamental frequency of 150 Hs and a set of integer harmonics above the fundamental with a decaying envelope typical of speech. The sample rate was 16 kHz. A 20 ms block size was used. It can be seen that all four embodiments provide useful discriminating power. The dynamic method was generally the most powerful, slightly ahead of the fixed masking method.

For these calculations, for the case of dynamic masking, the method considered candidate fundamental frequencies in the range of from 50 to 300 Hz for a transform with 50 Hz bin distance, and used quadratic interpolation around the three bins that include the detected peak location and the two neighboring bin frequencies to refine the results of peak detection. The half width of the mask window around a fundamental frequency $f_0$ or harmonic thereof is $f_0/8$. The harmonic range K is selected so that $Kf_0$ is necessarily less than the maximum transform bin frequency, e.g., less than 4 kHz. Generally between 1 and 4 candidate $f_0$ values were selected for analysis.

For the oversampled fundamental frequency fixed masking method, similar values were used to generate the results as those set out for the dynamic masking method. The oversampling ratio S was 4.

For the brute force method, similar values were used to generate the results as those set out for the dynamic masking method. The oversampling ratio S was 4. For a 20 ms transform and the indicated range for $f_0$, this created 21 times 4=84 candidates and pre-calculated masks.

Figure 9:
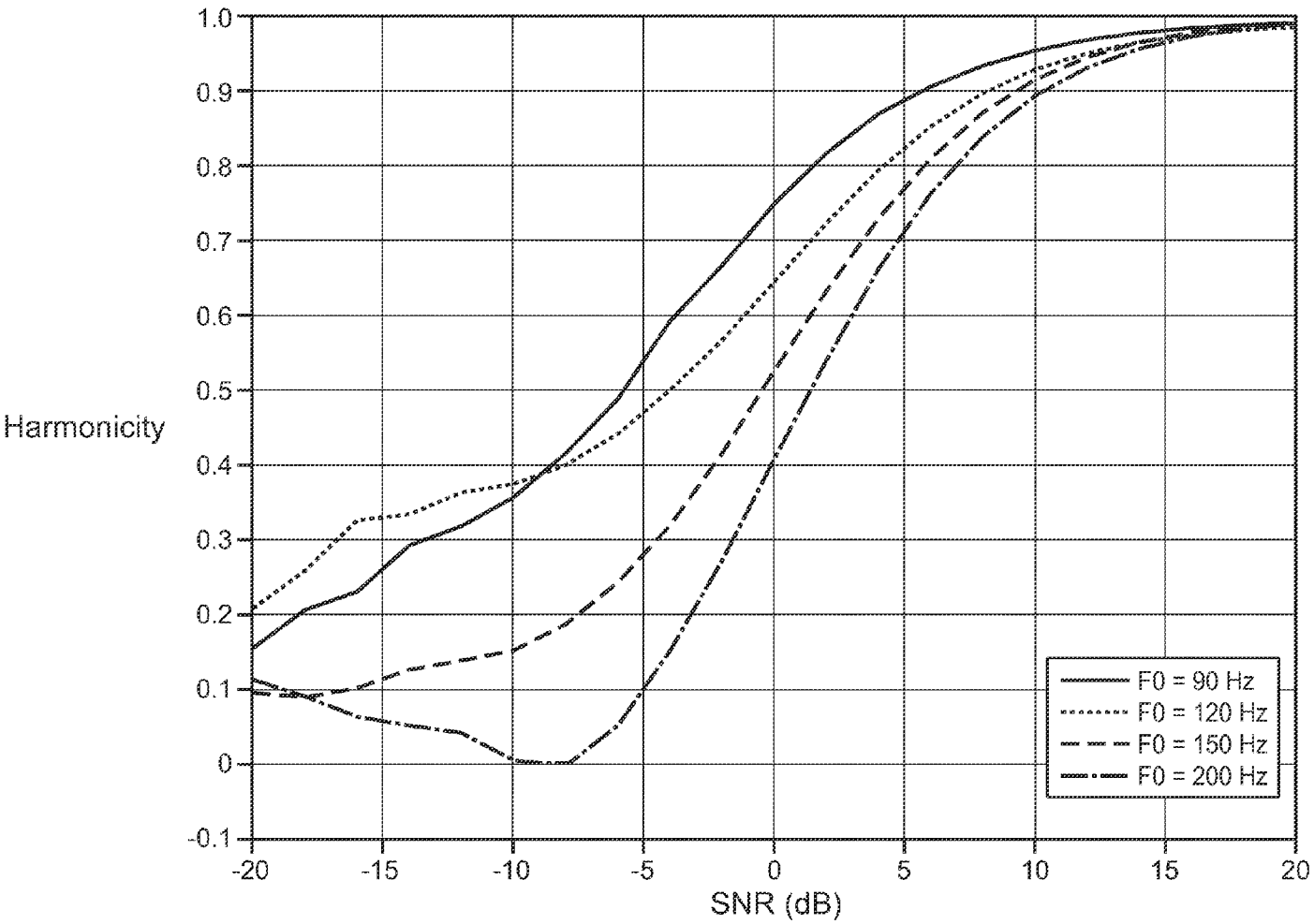
FIG. 9 is a graph showing the results of using a dynamic masking method embodiment of the present invention for a range of fundamental frequencies.

FIG. 9 shows the results of using the dynamic method embodiment of the present invention for a range of fundamental frequencies. The signals were constructed with a fundamental and a set of harmonics, and with varying amounts of noise. It was found that the performance was suitable across for fundamental frequencies across the typical range for voice signals.

Apparatuses and Methods that Include Determining a Measure of Harmonicity

The measure of harmonicity is applicable to voice processing, for example for voice activity detection and for a voice activity detector (VAD). Such voice processing is used for noise reduction, and the suppression of other undesired signals, such as echoes. Such voice processing is also useful in in levelling of program material in order for the voice content to be normalized, as in dialogue normalization.

The invention has many commercially useful applications, including (but not limited to) voice conferencing, mobile devices such as mobile telephones and tablet devices, gaming, cinema, home theater, and streaming applications. A processor configured to implement any of various embodiments of the inventive method can be included any of a variety of devices and systems, e.g., a speakerphone, a headset or other voice conferencing device, a mobile device such as a mobile telephone or tablet device, a home theatre, or other audio playback system, or an audio encoder. Alternatively, a processor configured to implement any of various embodiments of the inventive method can be coupled via a network, e.g., the Internet, to a local device or system, so that, for example, the processor can provide data indicative of a result of performing the method to the local system or device, e.g., in a cloud computing application.

Voice activity detection is a technique to determine a binary or probabilistic indicator of the presence of voice in a signal containing a mixture of voice and noise. Often the performance of voice activity detection is based on the accuracy of classification or detection. Voice activity detection can improve the performance of speech recognition. Voice activity detection can also be used for controlling the decision to transmit a signal in systems benefitting from an approach to discontinuous transmission. Voice activity detection is also used for controlling signal processing functions such as noise estimation, echo adaption and specific algorithmic tuning such as the filtering of gain coefficients in noise suppression systems.

The output of voice activity detection may be used directly for subsequent control or meta-data, and/or be used to control the nature of audio processing method working on the real time audio signal.

One particular application of interest for voice activity detection is in the area of Transmission control. For communication systems where an endpoint may cease transmission, or send a reduced data rate signal during periods of voice inactivity, the design and performance of a voice activity detector is critical to the perceived quality of the system.

Figure 6:
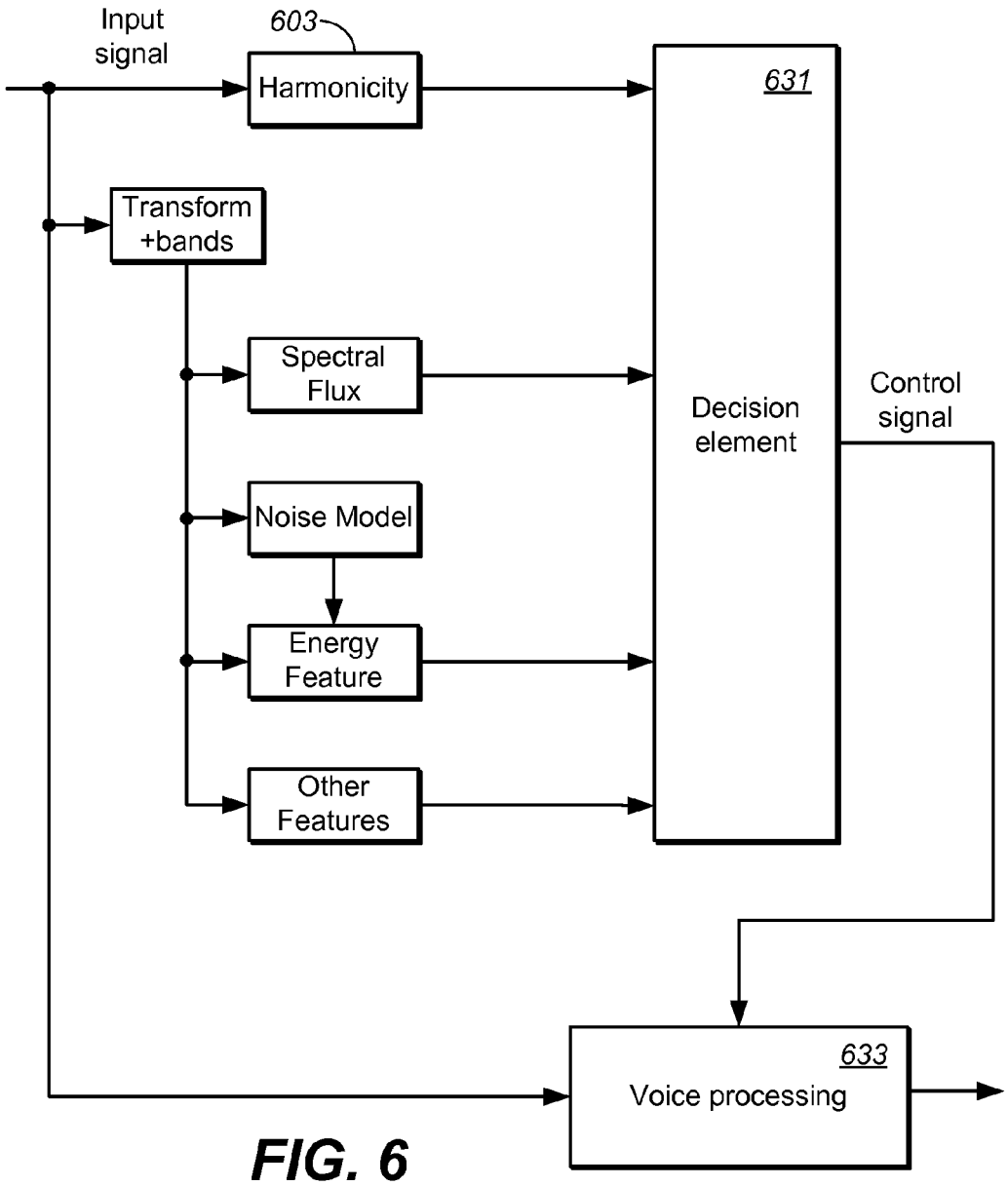
FIG. 6 is a block diagram illustrating an example apparatus 600 for performing voice activity detection according that includes an embodiment of the invention.

FIG. 6 is a block diagram illustrating an example apparatus 600 for performing voice activity detection according that includes an embodiment of the invention. The voice activity detector 101 is operative to perform voice activity detection on each frame of an audio input signal. The apparatus includes a calculator 601 of a measure of harmonicity as described in herein, e.g., in one of FIG. 3A, 3B, 4, or 5, that is operative to determine a measure of harmonicity. The voice activity detector includes a decision element 631 that ascertains whether the frame is voice or not according to the measure of harmonicity, and in some embodiments, one or more other features. In the embodiment shown, the other feature(s) are determined for a set of frequency bands, e.g., on an ERB (Equivalent Rectangular Bandwidth) or Bark frequency band perceptual scale. Most frequency bands include a plurality of frequency bins. Apparatus 600 thus includes a transformer and banding to determine banded measures of the input signal, e.g., a banded amplitude spectrum or banded power spectrum. For simplicity of exposition, the power spectrum is assumed. Examples of additional feature or features that can used for the voice activity detection include, but not limited to spectral flux, noise model, and energy feature. The decision element 631 may include making onset decision using a combination the measure of harmonicity and other feature(s) extracted from the present frame. Note that while in some embodiments, the other feature(s) are determined from a single frame to achieve a low latency for onset detection, in some applications, a slight delay in the onset decision (one or two frames) may be tolerated to improve the decision specificity of the onset detection, and therefore, the short-term features may be extracted from more than one frame. In case of the energy feature, a noise model may be used to aggregate a longer term feature of the input signal, and instantaneous spectra in bands are compared against the noise model to create an energy measure.

The decision element 631 carries out feature combination. In some versions, the decision element may use a rule for which training or tuning is needed. The output is a control signal that is indicative of whether or not the input signal is likely to include voice. This control signal is used in further voice processing element 633.

In some applications, rather than controlling an aspect of voice signal processing, the harmonicity measure, or some value derived from a rule dependent on the harmonicity measure is used as a value for representation in or control of meta-date, i.e., to create meta-data, or to include in metadata that is associated with an audio signal.

In some applications, the activity of speech, or the measure of harmonicity itself, determined as described herein, be logged, added to a meta-data stream, used to mark sections or to mark up an audio file. In such cases the processing may be real time, or may be offline, and the measure of harmonicity used accordingly.

Figure 7:
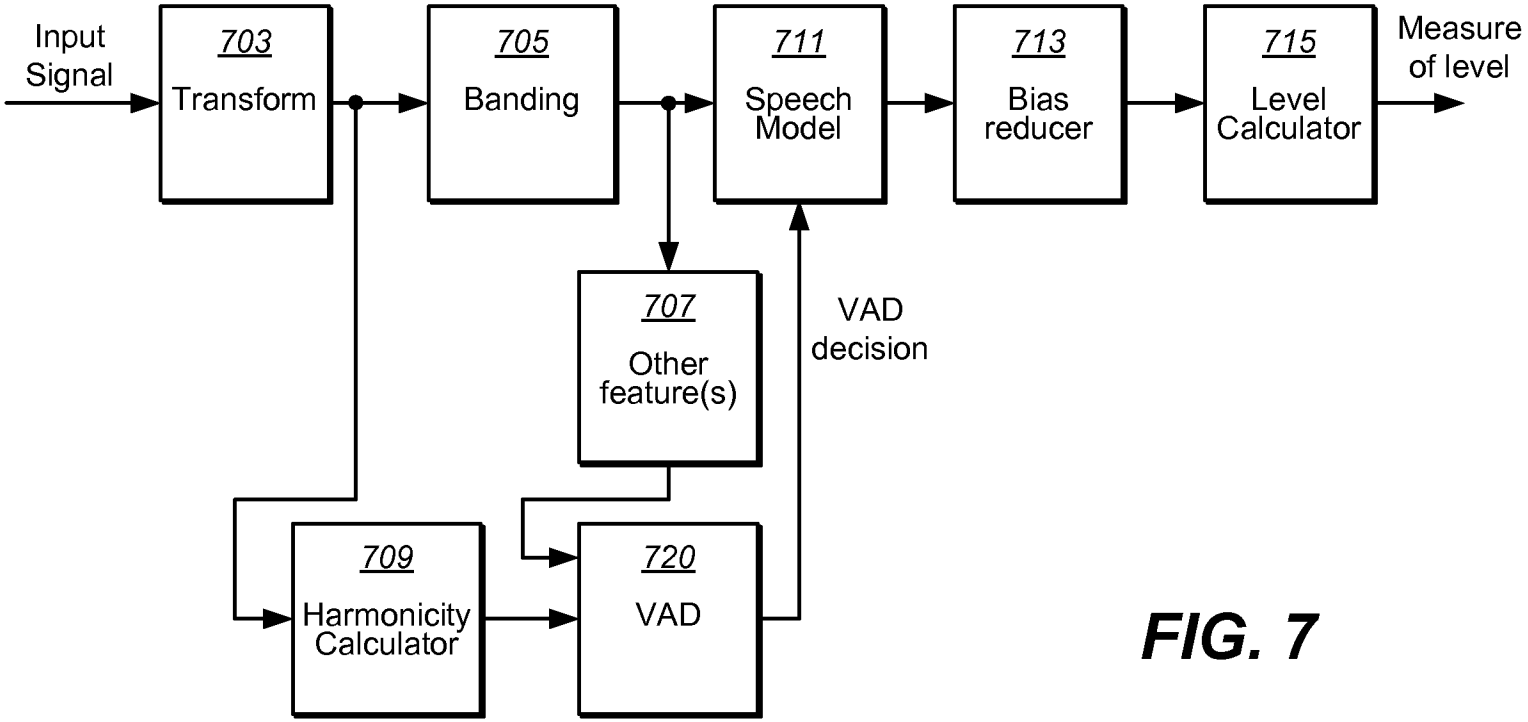
FIG. 7 is a block diagram of a system configured to determine bias-corrected speech level that uses a calculator of a measure of harmonicity according to any of the various embodiments of the invention described herein.

One application of an embodiment of the invention is to accurately determine the level of a signal that may contain voice. FIG. 7 is a block diagram of a system configured to determine bias corrected speech level values that uses a calculator 709 of a measure of harmonicity according to any of the various embodiments of the invention described herein. Element 703 carries out a time-to-frequency transform, element 705 carries out banding, e.g., on an ERB or Bark scale, element 707 extracts one or two banded features, element 720 is a VAD, and Element 711 uses a parametric spectral model of the speech signal and determines, for those frames that the VAD ascertains to be voice, an estimated mean speech level, and in some versions, an indication of standard deviation for each frequency band. Stages 713 and 715 implement bias reduction to determine a bias corrected estimated sound level for each frequency band of of each voice segment identified by the VAD 720.

In voice conferencing and mobile device applications, typical embodiments of a system as shown in FIG. 7 that includes an embodiment of the present invention can determine the speech level of an audio signal. e.g., to be reproduced using a loudspeaker of a mobile device or speakerphone, irrespective of noise level.

In cinema applications, a system such as shown in FIG. 7 that includes an embodiment of the present inventive method and system could, e.g., for example, determine the level of a speech signal in connection with automatic DIALNORM setting or a dialog enhancement strategy. For example, an embodiment of the inventive system shown in FIG. 7, e.g., included in an audio encoding system, could process an audio signal to determine a speech level thereof, thus determining a DIALNORM parameter indicative of the determined level for inclusion in an AC-3 encoded version of the signal. A DIALNORM parameter is one of the audio metadata parameters included in a conventional AC-3 bitstream for use in changing the sound of the program delivered to a listening environment. The DIALNORM parameter is intended to indicate the mean level of speech, e.g., dialog occurring an audio program, and is used to determine audio playback signal level. During playback of a bitstream comprising a sequence of different audio program segments, each having a different DIALNORM parameter, an AC-3 decoder uses the DIALNORM parameter of each segment to modify the playback level or loudness of such that the perceived loudness of the dialog of the sequence of segments is at a consistent level.

General

Unless specifically stated otherwise, it is appreciated that throughout the specification discussions using terms such as "generating," "processing," "computing," "calculating," "determining" or the like, may refer to, without limitation, the action and/or processes of hardware, e.g., an electronic circuit, a computer or computing system, or similar electronic computing device, that manipulate and/or transform data represented as physical, such as electronic, quantities into other data similarly represented as physical quantities.

In a similar manner, the term "processor" may refer to any device or portion of a device that processes electronic data, e.g., from registers and/or memory to transform that electronic data into other electronic data that, e.g., may be stored in registers and/or memory. A "computer" or a "computing machine" or a "computing platform" may include one or more processors.

Note that when a method is described that includes several elements, e.g., several steps, no ordering of such elements, e.g., of such steps is implied, unless specifically stated.

The methodologies described herein are, in some embodiments, performable by one or more processors that accept logic, instructions encoded on one or more computer-readable media. When executed by one or more of the processors, the instructions cause carrying out at least one of the methods described herein. Any processor capable of executing a set of instructions (sequential or otherwise) that specify actions to be taken is included. Thus, one example is a typical processing system that includes one or more processors. Each processor may include one or more of a CPU or similar element, a graphics processing unit (GPU), field-programmable gate array, application-specific integrated circuit, and/or a programmable DSP unit. The processing system further includes a storage subsystem with at least one storage medium, which may include memory embedded in a semiconductor device, or a separate memory subsystem including main RAM and/or a static RAM, and/or ROM, and also cache memory. The storage subsystem may further include one or more other storage devices, such as magnetic and/or optical and/or further solid state storage devices. A bus subsystem may be included for communicating between the components. The processing system further may be a distributed processing system with processors coupled by a network, e.g., via network interface devices or wireless network interface devices. If the processing system requires a display, such a display may be included, e.g., a liquid crystal display (LCD), organic light emitting display (OLED), or a cathode ray tube (CRT) display. If manual data entry is required, the processing system also includes an input device such as one or more of an alphanumeric input unit such as a keyboard, a pointing control device such as a mouse, and so forth. The term storage element, storage device, storage subsystem, or memory unit as used herein, if clear from the context and unless explicitly stated otherwise, also encompasses a storage system such as a disk drive unit. The processing system in some configurations may include a sound output device, and a network interface device.

In some embodiments, a non-transitory computer-readable medium is configured with, e.g., encoded with instructions, e.g., logic that when executed by one or more processors of a processing system such as a digital signal processing (DSP) device or subsystem that includes at least one processor element and a storage element, e.g., a storage subsystem, cause carrying out a method as described herein. Some embodiments are in the form of the logic itself. A non-transitory computer-readable medium is any computer-readable medium that is not specifically a transitory propagated signal or a transitory carrier wave or some other transitory transmission medium. The term "non-transitory computer-readable medium" thus covers any tangible computer-readable storage medium. Non-transitory computer-readable media include any tangible computer-readable storage media and may take many forms including non-volatile storage media and volatile storage media. Non-volatile storage media include, for example, static RAM, optical disks, magnetic disks, and magneto-optical disks. Volatile storage media includes dynamic memory, such as main memory in a processing system, and hardware registers in a processing system. In a typical processing system as described above, the storage element is a computer-readable storage medium that is configured with, e.g., encoded with instructions, e.g., logic, e.g., software that when executed by one or more processors, causes carrying out one or more of the method steps described herein. The software may reside in the hard disk, or may also reside, completely or at least partially, within the memory, e.g., RAM and/or within the processor registers during execution thereof by the computer system. Thus, the memory and the processor registers also constitute a non-transitory computer-readable medium on which can be encoded instructions to cause, when executed, carrying out method steps.

While the computer-readable medium is shown in an example embodiment to be a single medium, the term "medium" should be taken to include a single medium or multiple media (e.g., several memories, a centralized or distributed database, and/or associated caches and servers) that store the one or more sets of instructions.

Furthermore, a non-transitory computer-readable medium, e.g., a computer-readable storage medium may form a computer program product, or be included in a computer program product.

In alternative embodiments, the one or more processors operate as a standalone device or may be connected, e.g., networked to other processor(s), in a networked deployment, or the one or more processors may operate in the capacity of a server or a client machine in server-client network environment, or as a peer machine in a peer-to-peer or distributed network environment. The term processing system encompasses all such possibilities, unless explicitly excluded herein. The one or more processors may form a personal computer (PC), a media playback device, a headset device, a hands-free communication device, a tablet PC, a set-top box (STB), a personal digital assistant (PDA), a game machine, a cellular telephone, a Web appliance, a network router, switch or bridge, or any machine capable of executing a set of instructions (sequential or otherwise) that specify actions to be taken by that machine.

Note that while some diagram(s) only show(s) a single processor and a single storage element, e.g., a single memory that stores the logic including instructions, those skilled in the art will understand that many of the components described above are included, but not explicitly shown or described in order not to obscure the inventive aspect. For example, while only a single machine is illustrated, the term "machine" shall also be taken to include any collection of machines that individually or jointly execute a set (or multiple sets) of instructions to perform any one or more of the methodologies discussed herein.

Thus, as will be appreciated by those skilled in the art, embodiments of the present invention may be embodied as a method, an apparatus such as a special purpose apparatus, an apparatus such as a data processing system, logic, e.g., embodied in a non-transitory computer-readable medium, or a computer-readable medium that is encoded with instructions, e.g., a computer-readable storage medium configured as a computer program product. The computer-readable medium is configured with a set of instructions that when executed by one or more processors cause carrying out method steps. Accordingly, aspects of the present invention may take the form of a method, an entirely hardware embodiment, an entirely software embodiment or an embodiment combining software and hardware aspects. Furthermore, the present invention may take the form of program logic, e.g., a computer program on a computer-readable storage medium, or the computer-readable storage medium configured with computer-readable program code, e.g., a computer program product.

It will also be understood that embodiments of the present invention are not limited to any particular implementation or programming technique and that the invention may be implemented using any appropriate techniques for implementing the functionality described herein. Furthermore, embodiments are not limited to any particular programming language or operating system.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the above description of example embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the DESCRIPTION OF EXAMPLE EMBODIMENTS are hereby expressly incorporated into this DESCRIPTION OF EXAMPLE EMBODIMENTS, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those skilled in the art. For example, in the following claims, any of the claimed embodiments can be used in any combination.

Furthermore, some of the embodiments are described herein as a method or combination of elements of a method that can be implemented by a processor of a computer system or by other means of carrying out the function. Thus, a processor with the necessary instructions for carrying out such a method or element of a method forms a means for carrying out the method or element of a method. Furthermore, an element described herein of an apparatus embodiment is an example of a means for carrying out the function performed by the element for the purpose of carrying out the invention.

In the description provided herein, numerous specific details are set forth. However, it is understood that embodiments of the invention may be practiced without these specific details. In other instances, well-known methods, structures and techniques have not been shown in detail in order not to obscure an understanding of this description.

As used herein, unless otherwise specified, the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

While in one embodiment, the short time Fourier transform (STFT) is used to obtain the frequency bins, the invention is not limited to the STFT. Transforms such as the STFT are often referred to as circulant transforms. Most general forms of circulant transforms can be represented by buffering, a window, a twist (real value to complex value transformation) and a DFT, e.g., FFT. A complex twist after the DFT can be used to adjust the frequency domain representation to match specific transform definitions. The invention may be implemented by any of this class of transforms, including the modified DFT (MDFT), the short time Fourier transform (STFT), and with a longer window and wrapping, a conjugate quadrature mirror filter (CQMF). Other standard transforms such as the Modified discrete cosine transform (MDCT) and modified discrete sine transform (MDST), can also be used, with suitable regularization.

All U.S. patents, U.S. patent applications, and International (PCT) patent applications designating the United States cited herein are hereby incorporated by reference, except in those jurisdictions that do not permit incorporation by reference, in which case the Applicant reserves the right to insert any portion of or all such material into the specification by amendment without such insertion considered new matter. In the case the patent rules or statutes do not permit incorporation by reference of material that itself incorporates information by reference, the incorporation by reference of the material herein excludes any information incorporated by reference in such incorporated by reference material, unless such information is explicitly incorporated herein by reference.

Any discussion of other art in this specification should in no way be considered an admission that such art is widely known, is publicly known, or forms part of the general knowledge in the field at the time of invention.

In the claims below and the description herein, any one of the terms comprising, comprised of or which comprises is an open term that means including at least the elements/features that follow, but not excluding others. Thus, the term comprising, when used in the claims, should not be interpreted as being limitative to the means or elements or steps listed thereafter. For example, the scope of the expression a device comprising A and B should not be limited to devices consisting of only elements A and B. Any one of the terms including or which includes or that includes as used herein is also an open term that also means including at least the elements/features that follow the term, but not excluding others. Thus, including is synonymous with and means comprising.

Similarly, it is to be noticed that the term coupled, when used in the claims, should not be interpreted as being limitative to direct connections only. The terms "coupled" and "connected," along with their derivatives, may be used. It should be understood that these terms are not intended as synonyms for each other, but may be. Thus, the scope of the expression "a device A coupled to a device B" should not be limited to devices or systems wherein an input or output of device A is directly connected to an output or input of device B.

It means that there exists a path between device A and device B which may be a path including other devices or means in between. Furthermore, "coupled to" does not imply direction. Hence, the expression "a device A is coupled to a device B" may be synonymous with the expression "a device B is coupled to a device A." "Coupled" may mean that two or more elements are either in direct physical or electrical contact, or that two or more elements are not in direct contact with each other but yet still co-operate or interact with each other.

In addition, use of the "a" or "an" are used to describe elements and components of the embodiments herein. This is done merely for convenience and to give a general sense of the invention. This description should be read to include one or at least one and the singular also includes the plural unless it is obvious that it is meant otherwise.

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added to or deleted from methods described within the scope of the present invention.

What is claimed is:

1. A method of operating a processing apparatus to determine a measure of harmonicity of an audio signal, the method comprising:

accepting an audio input signal, the accepting providing digitized samples of the audio input signal, including in the case the audio input signal is an analog signal, using a digitizer on the analog input signal;

determining a spectrum of an amplitude measure for a set of frequencies, including time-to-frequency transforming the accepted audio input signal to form a set of frequency components of the audio signal at the set of frequencies; and determining as a measure of harmonicity a quantity indicative of the normalized difference of (i) the total spectral content based on the amplitude measure in a first subset of frequencies, said first subset corresponding to harmonic components of the audio signal, and (ii) the total spectral content based on the amplitude measure in a second subset of frequencies, said second subset corresponding to inharmonic components of the audio signal, said normalized difference being the difference normalized by the total spectral content in the first and second subsets, all total spectral contents being up to a maximum frequency.

2. A method as recited in claim 1, wherein the provided samples are in the form of a time frame of samples of the audio input signal, and wherein the time-to-frequency transforming performs a discrete Fourier transform of the time frame of samples of the audio input signal, such that the set of frequencies are a set of frequency bins.

3. A method as recited in claim 1, wherein the amplitude measure is the square of the amplitude, the total spectral content is a total energy determined as the sum of the squares of the amplitude up to the maximum frequency, and the measure of harmonicity is proportional or equal to the normalized difference between the total energy in the first subset and the total energy in the second subset normalized by the total energy in the first and second subsets, all total energies determined up to the maximum frequency.

4. A method as recited in claim 1, wherein the amplitude measure is the amplitude and the total spectral content is determined as the sum of amplitudes.

5. A method as recited in claim 1, wherein whether or not a frequency is in the first or second subset is indicated by a mask defined over frequencies that include the first and second subsets, wherein the mask has a positive value for each frequency in the first subset and a negative value for each frequency in the second subset, and wherein the determining of the difference in the determining of the measure of harmonicity includes determining the sum over the frequencies of the product of the mask and the spectral content based on the amplitude measure.

6. A method as recited in claim 5, wherein a mask associated with a selected fundamental frequency includes a window of positive values of width a pre-defined fraction of the selected fundamental frequency for each of a subset of harmonics of the selected fundamental frequency.

7. A method as recited in claim 5, wherein the mask has a positive first value for all frequencies in the first subset and the negative of the first value for all frequencies in the second subset, such that summing the product of the mask and the spectral content can be carried out by add operations.

8. A method as recited in claim 5, wherein determining the measure of harmonicity comprises:

determining one or more candidate fundamental frequencies in a range of frequencies, wherein each candidate fundamental frequency has an associated mask;

obtaining the one or more associated masks for the one or more candidate fundamental frequencies by selecting the one or more associated masks from a set of pre-calculate masks or by determining the one or more associated masks for the one or more candidate fundamental frequencies;

calculating a candidate measure of harmonicity for the one or more candidate fundamental frequencies; and selecting the maximum measure of harmonicity as the measure of harmonicity.

9. A method as recited in claim 8, wherein the determining the one or more candidate fundamental frequencies comprises detecting peaks in the amplitude measure spectrum of the signal.

10. A method as recited in claim 9, wherein the determining the one or more candidate fundamental frequencies further comprises determining the peaks in the amplitude measure spectrum at a finer frequency resolution than provided by the time-to-frequency transform.

11. An apparatus to determine a measure of harmonicity of an audio signal, the apparatus comprising:

a spectrum calculator operative to accept an audio input signal and calculate a spectrum of an amplitude measure for a set of frequencies, the spectrum calculator including a transformer to time-to-frequency transform digitized samples of the accepted audio input signal;

a fundamental frequency selector operative to determine a candidate fundamental frequency in a range of frequencies;

a mask determining element coupled to the fundamental frequency selector and operative to retrieve or calculate an associated mask for the candidate fundamental frequency;

a harmonicity measure calculator operative to determine a measure of harmonicity for the candidate fundamental frequency by determining the sum over the set of frequencies up to a maximum frequency of the product of the associated mask and the amplitude measure, divided by the sum over the set of frequencies up to the maximum frequency of the amplitude measure;

a maximum selector operative to select the maximum of candidate harmonicity measures determined by the harmonicity measure calculator for candidate fundamental frequencies in the range of frequencies, wherein the apparatus comprises at least one processor and at least one storage element that are operative to carry out at least one function of at least one of: the spectrum calculator, the fundamental frequency selector, the mask determining element, the harmonicity measure calculator, and the maximum selector wherein the spectrum calculator includes a digitizer in the case the audio input signal is an analog signal.

12. An apparatus as recited in claim 11, wherein the samples are in the form of a time frame of samples of the audio input signal, and wherein the time-to-frequency transforming performs a discrete Fourier transform of the time frame of samples of the audio input signal, such that the set of frequencies are a set of frequency bins.

13. An apparatus as recited in claim 12, wherein the fundamental frequency selector selects each frequency bin in the range of frequencies.

14. An apparatus as recited in claim 13, wherein the fundamental frequency selector is operative on an amplitude measure spectrum oversampled in frequency to obtain the candidate fundamental frequencies over a finer frequency resolution than provided by the time-to-frequency transform.

15. An apparatus as recited in claim 13, wherein at least one of the one or more storage elements stores a data structure of pre-calculated masks, wherein the apparatus further comprises:

a plurality of mask determining elements coupled to the storage element and operative to retrieve an associated mask for a different one of the frequency bins in the range of frequencies; and a plurality of harmonicity measure calculators, each harmonicity measure calculator couplet to a respective one of the mask determining elements to form, in combination, a harmonicity measure forming element operative to determine a measure of harmonicity using the associated mask retrieved by the mask determining element, and wherein the harmonicity measure forming elements operate in parallel.

16. An apparatus as recited in claim 11, wherein the amplitude measure is the square of the amplitude.

17. An apparatus as recited in claim 11, wherein the amplitude measure is the amplitude.

18. An apparatus as recited in claim 11, wherein the fundamental frequency selector comprises a peak detector to detect peaks in the amplitude measure spectrum of the signal.

19. An apparatus as recited in claim 11, wherein a mask associated with a selected fundamental frequency includes a window of positive values of width a pre-defined fraction of the selected fundamental frequency for each of a subset of harmonics of the selected fundamental frequency.

20. An apparatus as recited in claim 11, wherein the mask has a positive first value for all frequencies corresponding to harmonic content and the negative of the first value for all frequencies corresponding to inharmonic content, and wherein all frequencies correspond to either harmonic content or inharmonic content such that the harmonicity measure calculator determines the sum of the product of the mask and the amplitude measure spectrum by add operations.

* * * * *